United States Patent [19]

Daswick et al.

[11] 4,195,882

[45] Apr. 1, 1980

[54] ADJUSTABLE CONVERTIBLE FURNITURE FOR SUPPORTING ONE OR MORE PERSONS

[75] Inventors: Alexander C. Daswick, 647 Orange Grove, Apt. 209, South Pasadena, Calif. 91030; Archie C. Landry, Canoga Park, Calif.

[73] Assignee: Alexander C. Daswick, South Pasadena, Calif.

[21] Appl. No.: 947,359

[22] Filed: Oct. 2, 1978

Related U.S. Application Data

[63] Continuation-in-part of Ser. No. 826,033, Aug. 19, 1977, abandoned.

[51] Int. Cl.[2] ..... A47C 17/00

[52] U.S. Cl. ..... 297/242; 5/12 R; 5/59 R; 297/383

[58] Field of Search ..... 5/12, 53 R, 59 R, 60, 5/185; 297/240–242, 245, 353, 383, 407, 451

[56] References Cited

U.S. PATENT DOCUMENTS

| | | | |
|---|---|---|---|
| B 298,040 | 1/1967 | Radel | 5/12 R |
| 825,736 | 7/1906 | Kilburn et al. | 297/242 |
| 831,063 | 9/1906 | Hale | 297/242 |
| 2,305,183 | 12/1942 | Mehr | 5/12 R |
| 3,145,053 | 8/1964 | Thompson et al. | 297/383 |
| 3,342,528 | 9/1967 | Radke et al. | 297/407 |
| 3,711,875 | 1/1973 | Cox | 5/2 |

*Primary Examiner*—Casmir A. Nunberg
*Attorney, Agent, or Firm*—Gene W. Arant

[57] ABSTRACT

An adjustable and convertible piece of furniture for accommodating single or multiple persons in multipositions. The piece may comprise a chair, couch, bed, or recreational support of novel configuration facilitating face to face conversation among several persons sitting, lounging, game playing, TV viewing, snacking, sleeping, or participating in other recreation.

A unitary frame supports a cushioned horizontal surface above the floor or ground on a plurality of legs. The frame carries inner and outer tracks depending from its under side, therefrom, with the tracks being outboard of the legs, in spaced apart relation to each other. The tracks support a plurality of backrests, independently positionable along the border of the frame, via outwardly protruding cantilever means extending upwardly as vertical supporting means, in turn carrying horizontal backrest members at levels above the elevation of the cushioned surface. The space above the cushioned surface is otherwise unobstructed. The track mounted cantilever means and vertical supporting means permit horizontal displacement of the backrest members along a path substantially parallel to the border of the cushioned surface, and each backrest member is adjustable to and fro of said border, vertically of the cushioned surface, and laterally of the vertical supporting means, as well as being rotatable about a vertical axis relative thereto.

26 Claims, 37 Drawing Figures

Fig. 3.
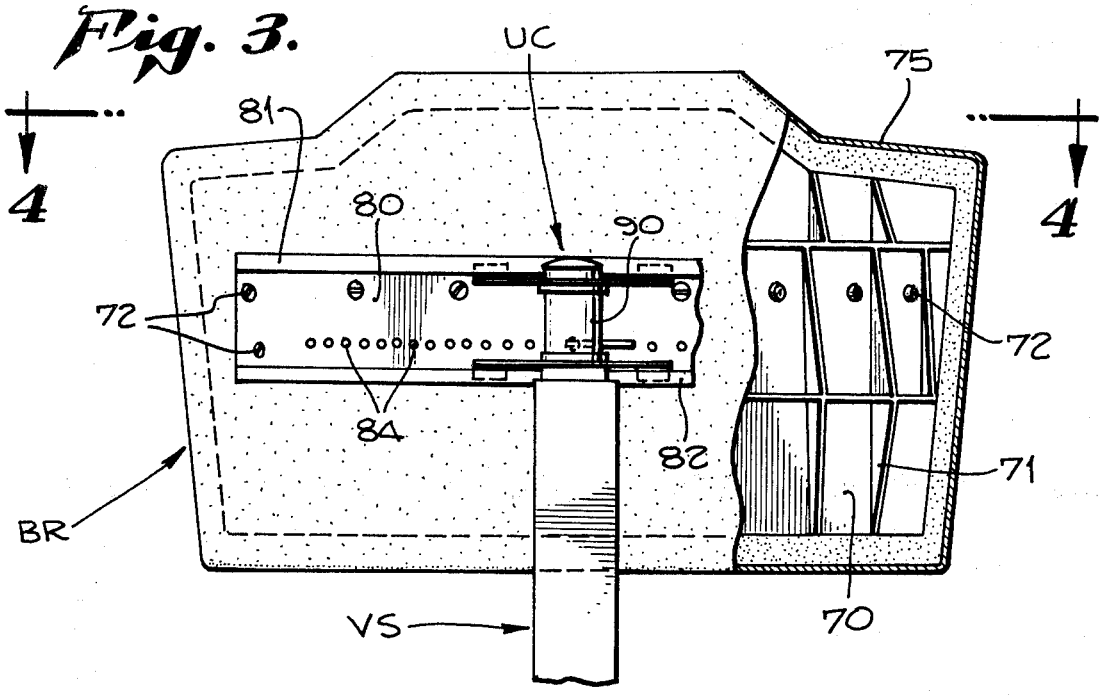
Fig. 4.
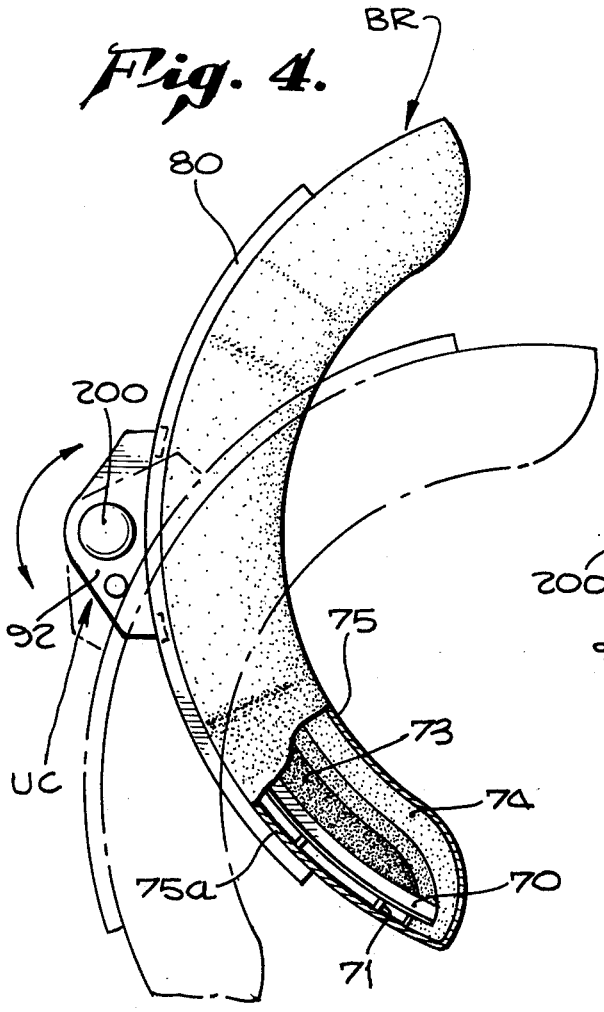
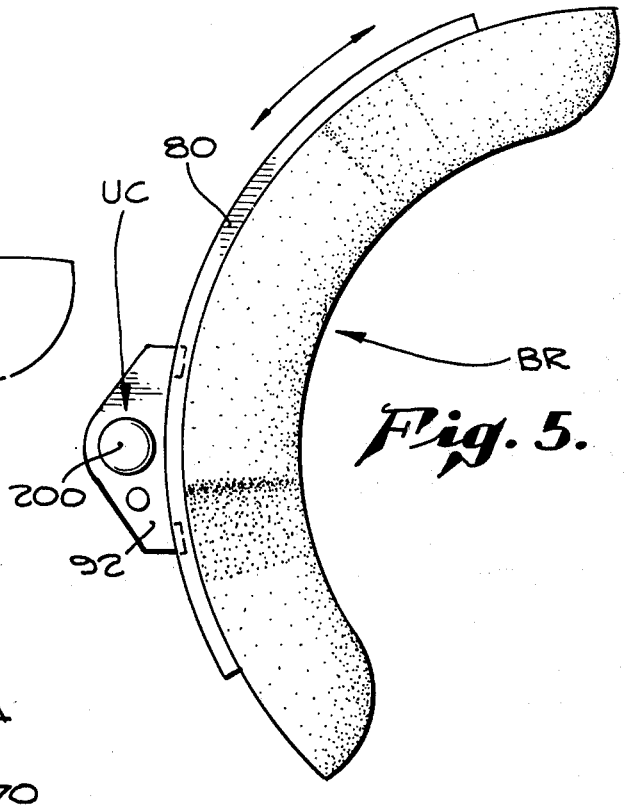
Fig. 5.

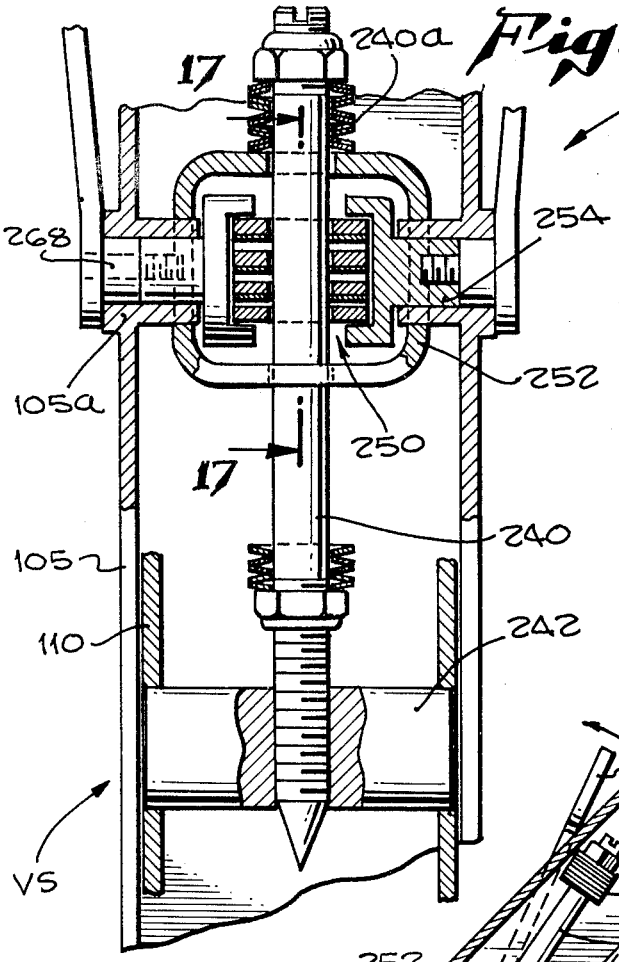
Fig. 16.
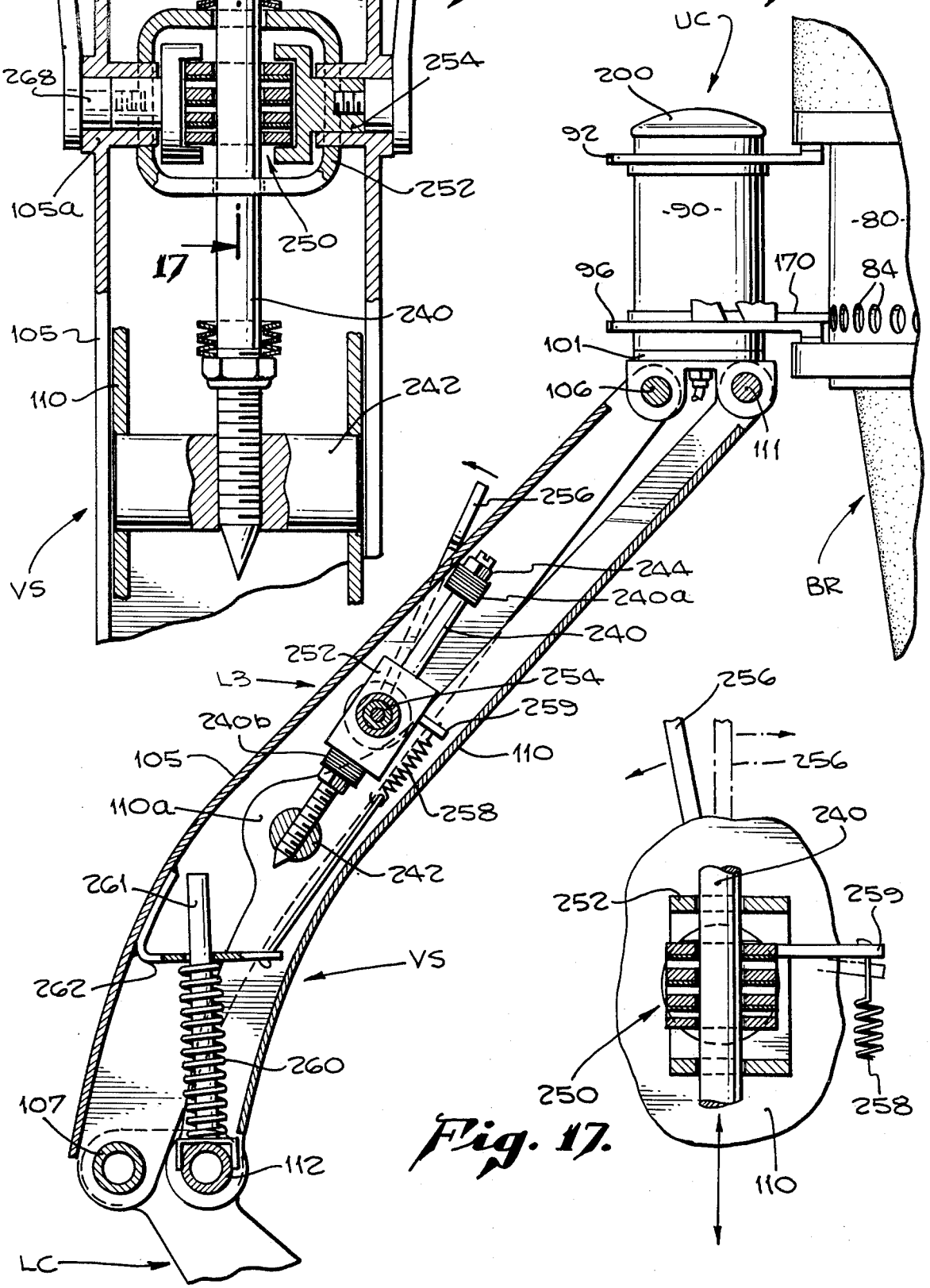
Fig. 18.
Fig. 17.

Fig. 33.
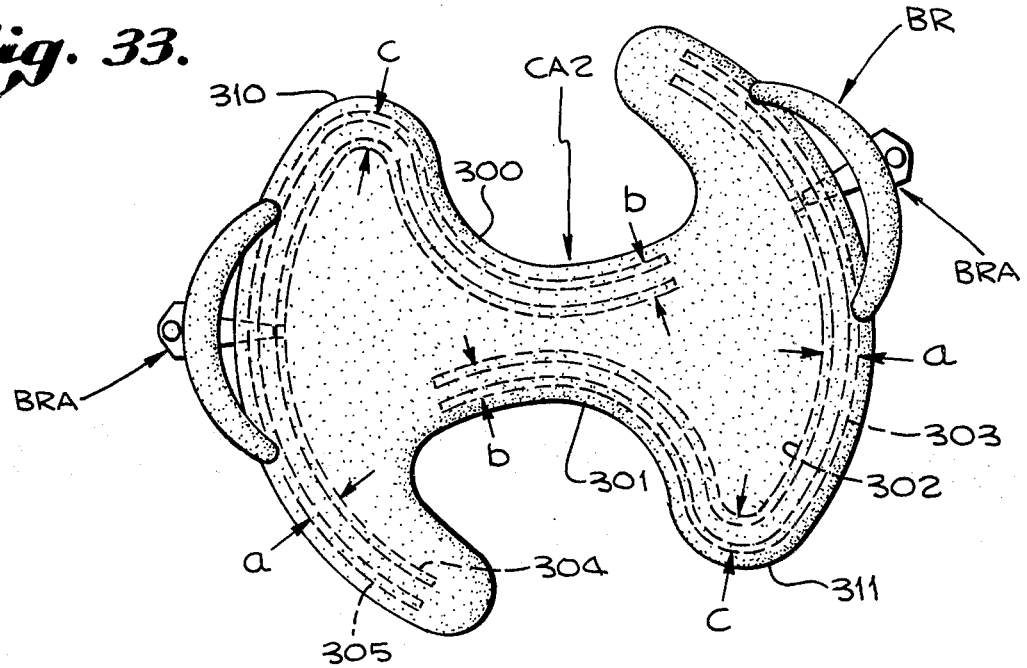
Fig. 34.
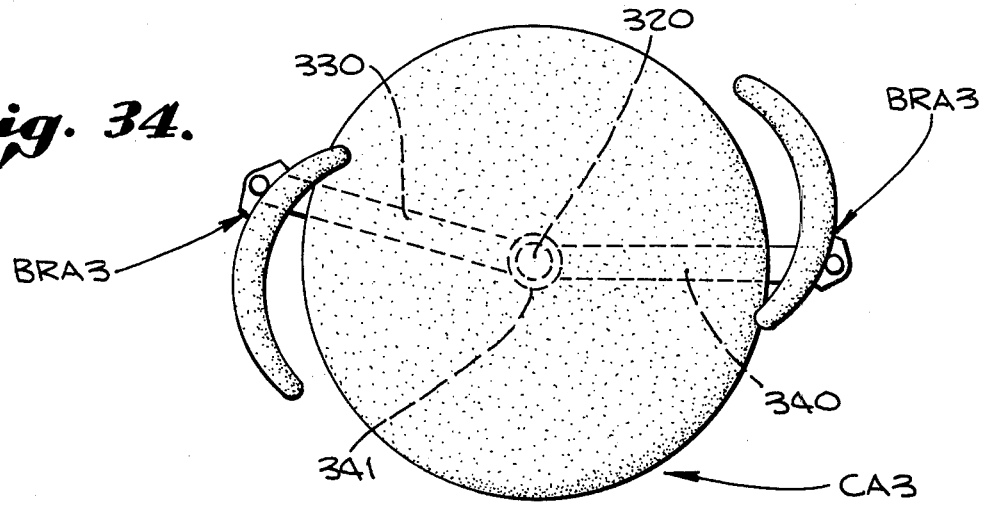
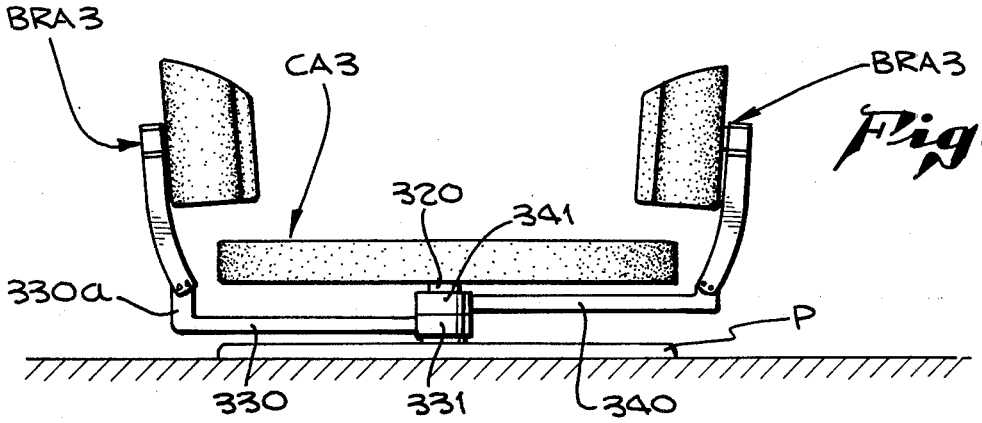
Fig. 35.

ADJUSTABLE CONVERTIBLE FURNITURE FOR SUPPORTING ONE OR MORE PERSONS

RELATED CASES

The subject application is a continuation-in-part of U.S. Ser. No. 826,033, filed Aug. 19, 1977, for LOUNGE CHAIR, by the same inventors, and abandoned upon the filing of the present case.

FIELD OF THE INVENTION

The invention relates to furniture, and more particularly to adjustable convertible multi-use furniture for accommodating one or more persons simultaneously.

BACKGROUND OF THE INVENTION

Various types of sofas and convertible sofas have been proposed which permit two people to share in an intimate way a single piece of furniture. One example is the love seat designed with the backs of two seats joined in side-by-side relation but with the backs arranged in an S-shaped curve, permitting the users to sit side by side but facing in opposite directions. This arrangement allows the persons using the seats to sit more comfortably while still facing each other. Convertible sofas which either can be used for sitting or which can be opened up for sleeping or lying in a prone position are also well known.

U.S. Pat. 3,298,040 issued Jan. 17, 1967 to K. Radel for ROUND DOUBLE BED OF THE TYPE CONVERTIBLE INTO A SINGLE OR COUBLE COUCH discloses a double round bed convertible into a single or double couch by pivoting a smaller semi-circular section from beneath a larger higher semi-circular section and adding a pad for common horizontal height. Arcuate rests constituting armrests for the couch are shiftable along the circumference of the frame to constitute footrests on the double bed.

No prior art is known wherein multiple backrests are essentially universally and independently adjustable relative to a cushioned supporting surface; nor where the space above the cushioned supporting surface is otherwise unobstructed; nor wherein a unitary frame accommodates the foregoing; nor is any structure or method known capable of the functions and new uses of the present invention.

SUMMARY OF THE INVENTION

The present invention is directed to an adjustable convertible furniture which combines the advantages of known types of pieces, using less floor space than multiple pieces and offering unique advantages heretofore unavailable. Thus, the present invention provides an arrangement which can be used by either one, two or more people lying prone, sitting up in a lounging position with the feet stretched out in front of them, or in a sitting position with their feet on the floor but substantially facing each other while in the lounging or sitting positions. They can also adjust the device to permit side-by-side seating or lounging while facing in the same direction, or assume other numerous positions.

These and other features of the present invention are provided by a piece of furniture providing a cushioned horizontal surface which may be any one of a variety of shapes and sizes designed to accommodate people sitting, lounging, or lying on the cushioned surface. The cushioned surface is supported from the floor by a central pedestal, legs, or other suitable support means. Cantilevered backrest support members are movably attached to the underside of the cushioned surface and extending outwardly thereof and upwardly as vertical support means above the cushioned surface at the border thereof. A backrest member is adjustably supported above the cushioned surface by each of the vertical supporting means. The upper end of each cantilevered vertical support means, in addition to being movable in a path following the outer contour of the cushioned surface, is preferably adjustable in a direction towards and away from the cushioned surface. The backrests are countoured and attached to the upper end of the cantilever vertical means by adjustable means which allows the backrests to be rotated relative to the support members about a vertical axis and also to be adjusted horizontally relative to the upper end of the cantilever vertical means so that the backrests can be supported at either end or at any intermediate point along the arc of the backrests.

DRAWING SUMMARY

The invention will be better understood from a reading of the ensuing detailed description thereof, when taken in conjunction with the accompanying drawings, wherein:

FIG. 3 is a rear elevation view of a backrest member, partly broken away to reveal its internal structure;

FIG. 4 is a plan view of the backrest member of FIG. 3, also showing in dashed lines the backrest member pivoted about a vertical axis into an alternate position;

FIG. 5 shows the backrest member of FIG. 4 offset from support at its center in the direction of one end thereof;

FIG. 16 is a sectional elevational view of the latch structure for the vertical support, taken on the plane 16—16 of FIG. 6;

FIG. 17 is a further sectional view of the structure of FIG. 16 taken along the plane 17—17 of FIG. 16;

FIG. 18 is a sectional view of the vertical support means to show the internal latch mechanisms contained therein;

FIG. 33 is a haphazardly configured piece of furniture incorporating an alternate form of the invention, as seen in plan view;

FIG. 34 is a plan view of a further embodiment of the invention which is pedestal supported;

FIG. 35 is a view in elevation of the embodiment of FIG. 34;

FIG. 36 is a view in plan of a combination bed-couch incorporating the invention for conserving floor space in motels and the like.

PREFERRED EMBODIMENT

(FIGS. 1–32)

Reference is now made to FIGS. 1 to 32, inclusive, of the drawings which illustrate the presently preferred embodiment of the invention.

In this particular embodiment of the invention the couch assembly CA is circular and has a diameter of about 42 inches. Six legs L are attached underneath the couch assembly in its central area. An outer track OT is attached underneath the couch assembly near its outer periphery, and a concentric inner track IT is also supported underneath the couch assembly. The legs L are attached to the couch interiorly of the inner track.

This embodiment of the invention also includes a pair of identical backrest assemblies BRA, which are supported from the tracks of the couch assembly and are movable and adjustable in various ways. The principal component parts of each backrest assembly include a lower carriage LC whose rollers ride upon the tracks; a vertical support VS extending upward from the lower carriage and alongside the couch; an upper carriage UC on the upper end of the vertical support; and a backrest BR attached to the upper carriage.

The couch assembly will first be described in detail, and the backrest assembly will then be described. The complete apparatus includes a number of parts which are utilized for position adjustment purposes, which will be described separately.

Each of the position adjustment mechanisms is accompanied by a latch mechanism whose function it is to maintain a particular position that has been selected. For purpose of clarity the description of the latch mechanisms is not included in the initial description of the main assemblies. The various latch mechanisms are thereafter described in appropriately labeled separate paragraphs.

COUCH ASSEMBLY

(FIGS. 1, 2, 19–32)

Figure 19:
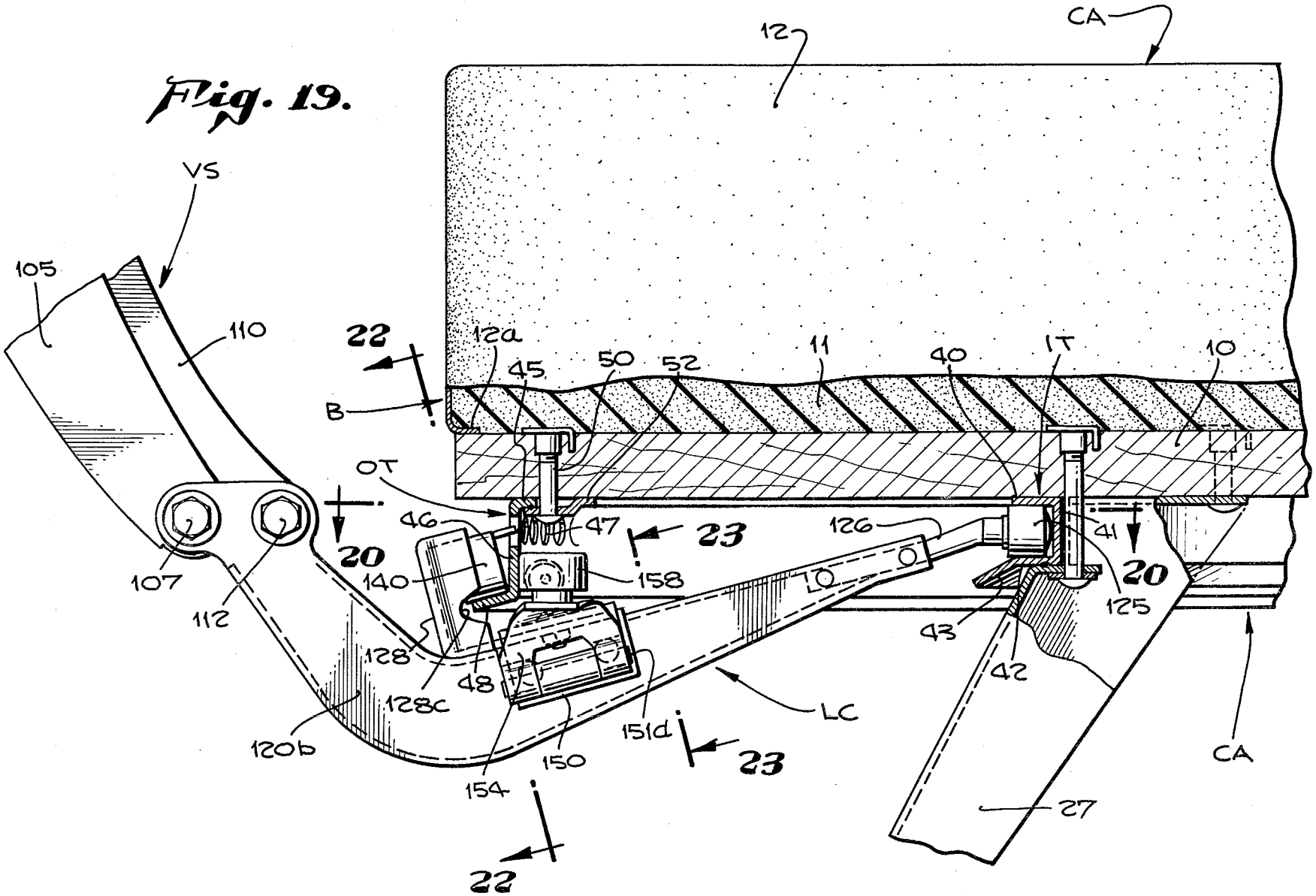
FIG. 19 is a side elevational view of the cantilever means supported on the tracks of the couch assembly.
Figures 27, 28, 29, 30:
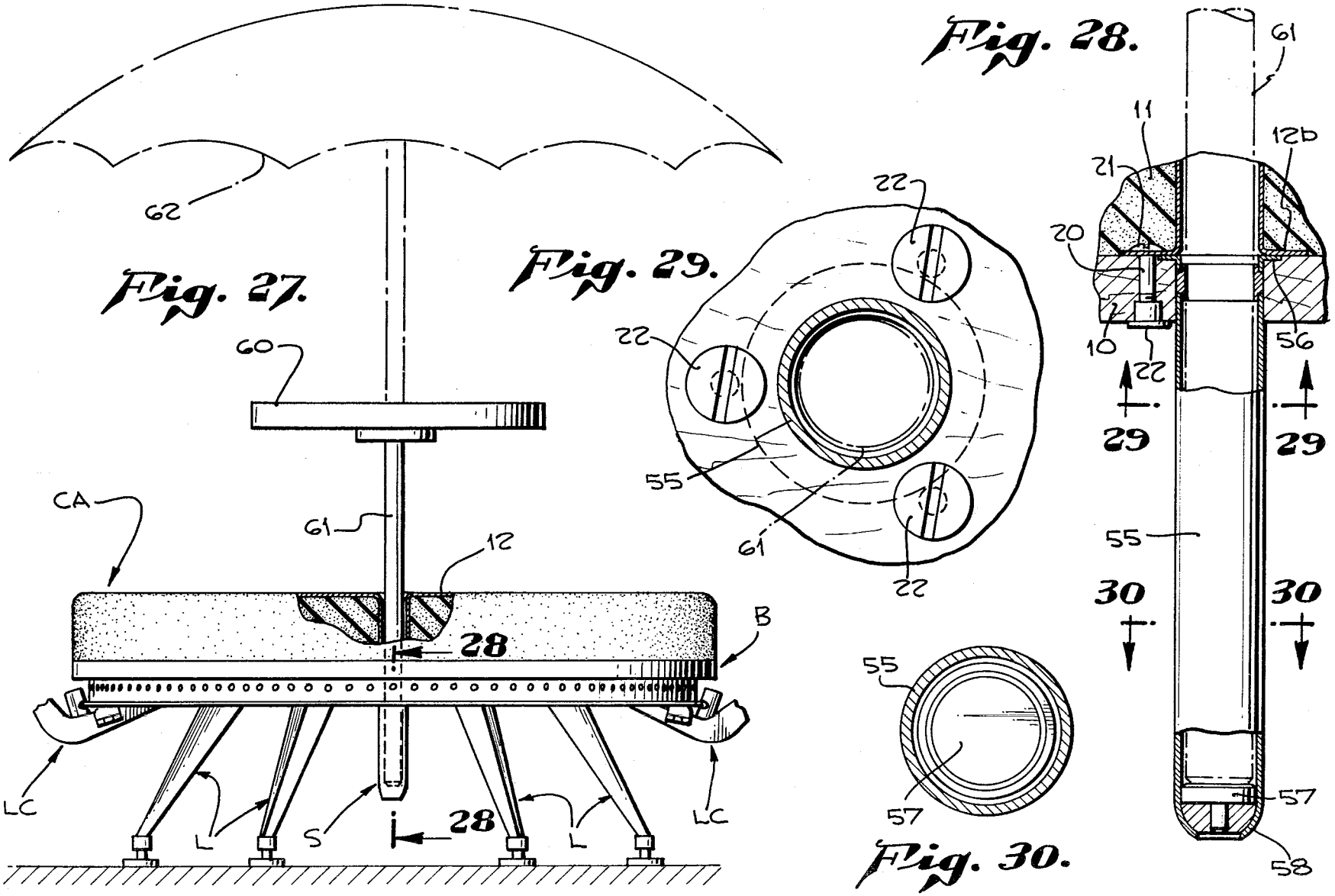
FIG. 27 is a view in elevation of the preferred embodiment of the invention with a central umbrella awning shade added for outdoor use.
FIG. 28 is a sectional view from FIG. 27 showing the mounting socket for the umbrella shaft.
FIG. 29 is a further detailed showing of such mounting structure from FIG. 28.
FIG. 30 is a further detail of the socket from line 30—30 of FIG. 28.

In the couch assembly CA the base B includes a flat circular wooden base plate 10 which is best seen in FIGS. 19 and 28. A cushion 11 of generally cylindrical configuration rests upon the base plate 10 and is covered with a flexible removable cover member 12. Cover member 12 extends across the flat upper surface of the cushion 11 and also around the cylindrical surface at its periphery. Further, the outer edge of the cover tucks in between the cushion 11 and base plate 10 at 12*a*, as shown in FIG. 19.

Figure 1:
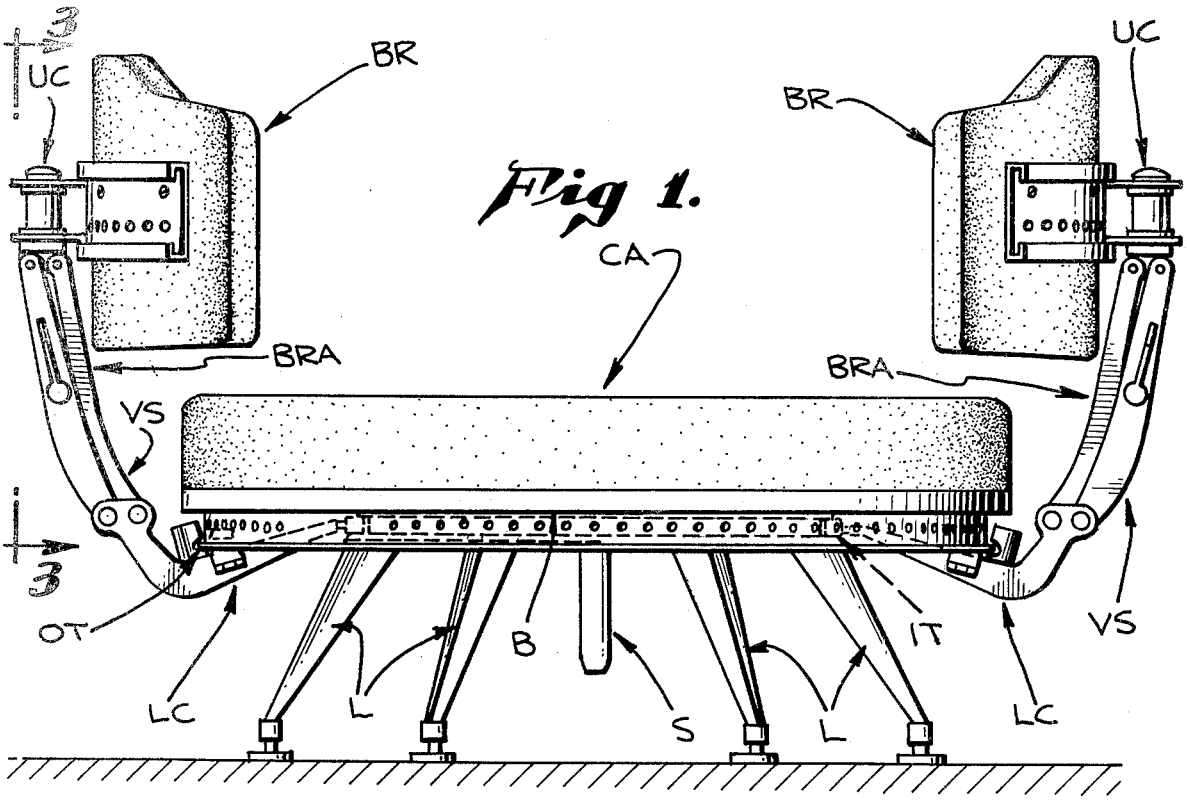
FIG. 1 is a view in side elevation of a piece of furniture in accordance with the preferred embodiment of the invention.
Figure 2:
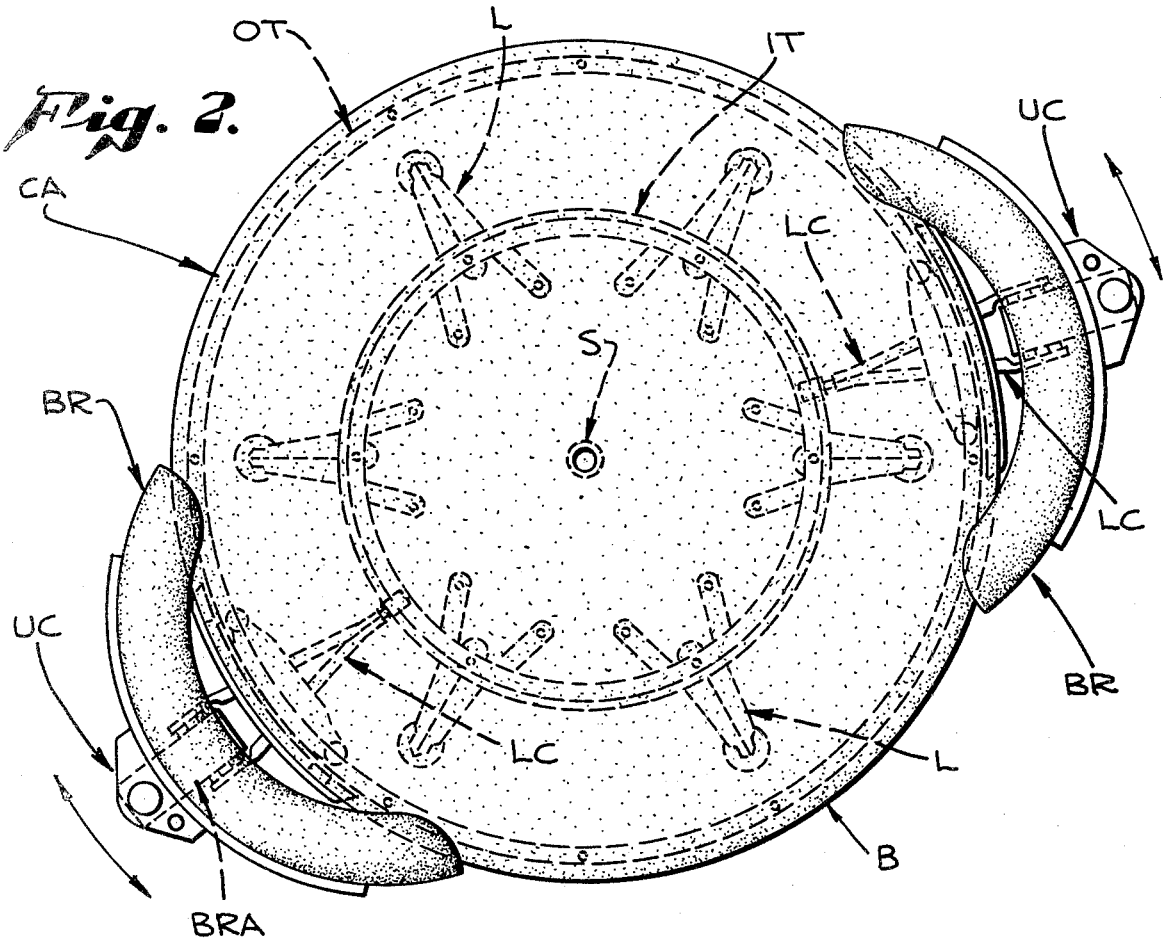
FIG. 2 is top a plan view of the structure of FIG. 1.

Both the base plate 10 and the cushion 11 have a central opening therein, as best seen in FIGS. 2, 27, and 28. Cover 12 extends downward through this central opening and has an inner edge 12*b* which is tucked in between the cushion and the base plate, as shown in FIG. 28. The purpose of the central opening is to hold an umbrella socket, as will be later described.

A set of three bolts 20 are spaced around the umbrella socket as shown in FIGS. 28 and 29. Each bolt has a head 21 which grasps a corresponding point on the cover 12*b* and secures it firmly downward against the base plate 10. A nut 22 attached from the underside of the base plate holds the bolt in place. These bolts hold the cover 12 which in turn holds the cushion 11 in place. Cushion 11 and cover 12 are therefore designed as a removable unit, which after wear may be conveniently removed and replaced in the field and without necessity of returning the couch assembly to the factory.

There are six of the legs L and they are identical. They are equally spaced around the underside of base plate 10 as best seen in FIG. 2. The structure of the legs is shown in FIGS. 1, 2, 31 and 32. Thus each leg includes a flange plate 23 having separate inner flanges 24*a*, 24*b* and an outer flange 25 to which respective fastening bolts are attached. A horizontal shoulder 26 that is also an integrally formed part of the metal leg is located about one inch below the flange plate. See FIG. 31. Shoulder 26 provides a means for grasping and supporting the inner track IT. The main leg structure 27 extends downward and outwardly from the flange plate 23 and shoulder 26. A foot 28 is pivotally attached to the lower end of the main leg structure.

Figure 31:
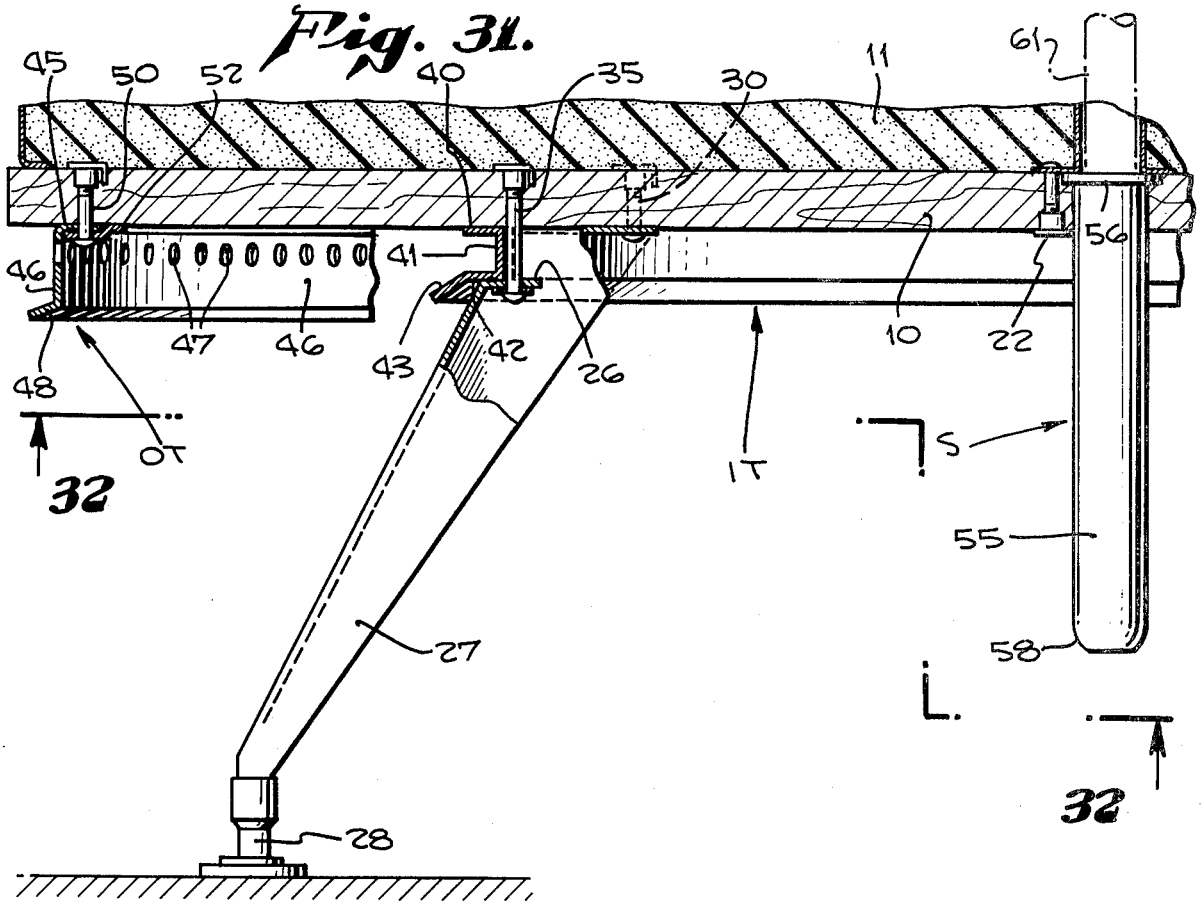
FIG. 31 is an elevational view of a radial section of the couch assembly.
Figure 32:
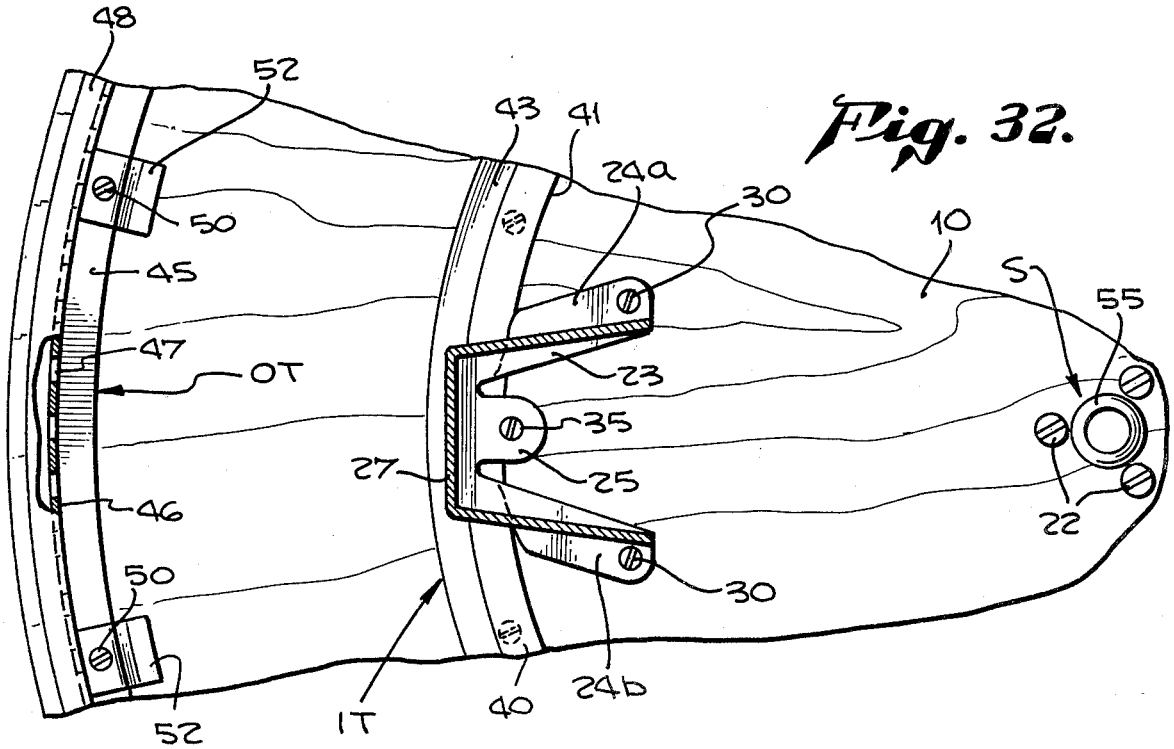
FIG. 32 is a bottom view of a couch assembly as seen along the plane 32—32 of FIG. 31.

The inner flanges 24*a*, 24*b* are fastened to the wooden base plate 10 by means of bolts 30, FIGS. 31 and 32. Each outer flange 25 is secured to the base plate by a bolt 35. Bolt 35 is so positioned as to support the radially inward wall of the inner track IT, as shown in FIG. 31. Thus the six legs L together with their corresponding bolts 35 firmly support the inner track both vertically and radially.

Inner track IT is of a modified channel configuration as best seen in FIGS. 19 and 31. The metal track has a vertical wall 41 of cylindrical configuration which engages the circular array of bolts 35; a horizontal upper wall 40 which extends radially outward from the upper edge of the vertical wall 41 and engages the under surface of base plate 10; a horizontal lower wall 42 which is parallel to and substantially coextensive with the upper wall 40; and an inclined flange 43 which extends outwardly and downwardly from the lower wall 42.

Outer track OT, best seen in FIGS. 19 and 31, has a horizontal upper wall 45 which engages the under surface of base plate 10, and a vertical wall 46 extending downwardly from the radially outer edge of the upper wall 45. The upper portion of vertical wall 46 has latching holes 47 spaced around its entire cylindrical surface. An angled track flange 48 extends outwardly and downwardly from the lower end of the vertical wall 46. The tracks IT and OT are concentric.

A number of bolts 50 are positioned on the radially inward edge of the upper wall 45 and pass through the base plate 10 for securing outer track OT thereto. Each bolt 50 is accompanied by a holding clip 52 which assists the bolt in firmly grasping the upper flange 45 of the track.

Umbrella socket S is shown in FIGS. 1 and 27–32. It is provided by a metal tube 55 which occupies the center hole in wooden base plate 10. The upper end of the tube is outwardly flanged at 56 to provide vertical support of the tube, and base plate 10 is accordingly recessed to receive the flange. A bottom plug 57 (FIG. 28) is placed in the lower end of the tube and the lower extremity of the tube is then turned in at 58 in order to confine the plug therein.

FIG. 27 shows a circular serving tray 60 supported on a post 61 which passes through the central hole in cushion 11 and hence into the tube 55 where its lower end is supported on plug 57. Also shown in dotted lines as a possible upward extension of serving tray 60 is an umbrella 62. Both the serving tray and the umbrella are optional features of the invention, and of course an umbrella may if desired be used without a serving tray or vice versa. As an alternative, the couch assembly may omit the socket S altogether.

BACKREST ASSEMBLY

FIGS. 1–20, 22–26)

The backrest assembly receives it support from tracks IT and OT of the couch assembly through the lower carriage LC. It is believed more convenient, however, to firt describe the upper structure of the backrest assembly and then subsequently describe the lower structure that supports it.

Figure 6:
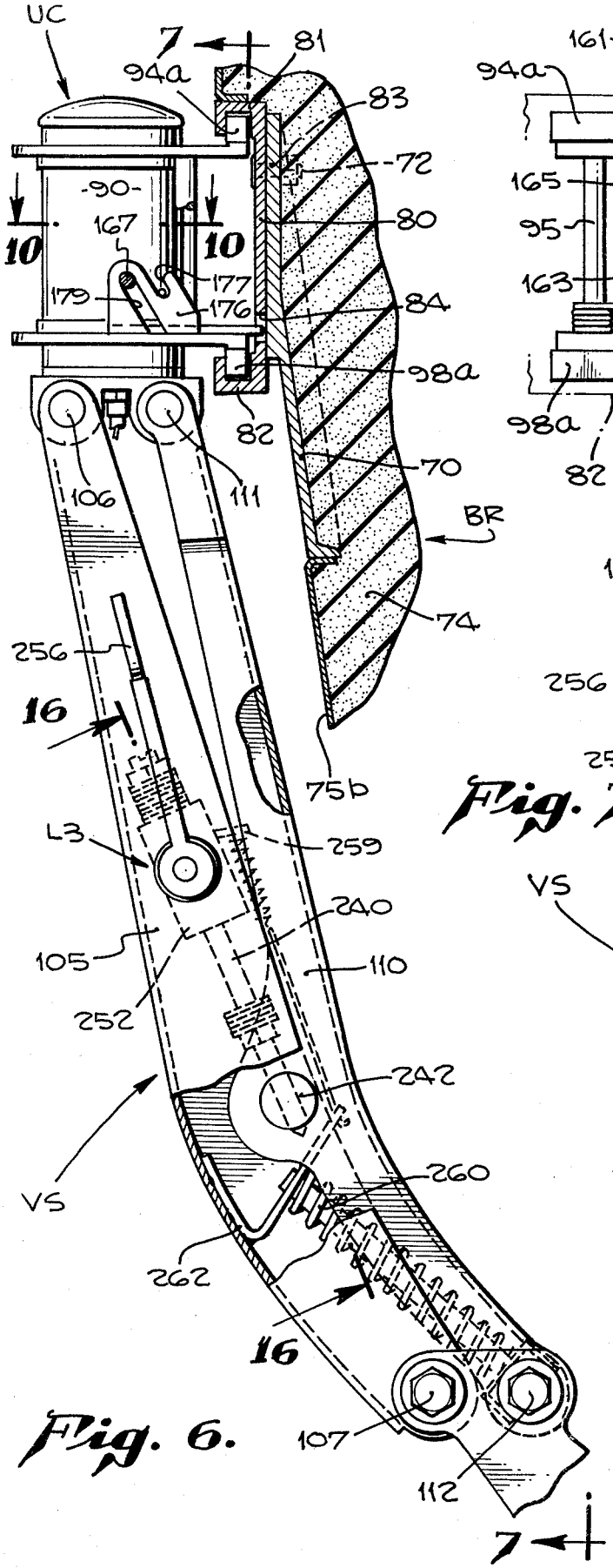
FIG. 6 is an enlarged view in side elevation, partly broken away, showing the vertical support means for the backrest member.

Backrest BR includes a plastic frame 70 which is substantially vertically positioned and which is arcuately curved in the horizontal plane. See FIGS. 1–6. The frame has a grid of both horizontal and vertical ribs 71 integrally formed on its backside, as best seen in FIGS. 3, 4, and 6. A row of horizontally spaced fasteners 72 also protrude from the backside of frame 70. The fasteners are used for attaching a metal track 80 which, in turn, provides the means for supporting the backrest BR, as well as forming part of the means for making one of the position adjustments for the backrest.

As seen in FIG. 4 a relatively hard inner cushion 73 is mounted on the front surface of plastic frame 70. A relatively soft cushion 74 is placed in front of the cushion 73 and has extending curved portions which not only cover the upper and lower and lateral edges of the inner cushion 73, but also the corresponding edges of metal frame 70. The cushion assembly in turn is covered by a flexible cover sheet 75.

The cover sheet 75 has portions such as **75*a* which extend around the backside of metal frame 70 and are there fastened in place by attachment of the metal track 80 to the metal frame 70**. Thus a removable cushion assembly is formed, similar to that used in conjunction with couch assembly CA. When a particular cushion is worn it may be replaced in the field, without the necessity of returning the backrest assembly to the factory.

The metal track 80 as seen in FIG. 6 has a flanged upper wall 81 and a flanged lower wall 82. The track 80 is therefore of generally channel-shaped configuration but with both of its side walls turned inwardly towards each other. The track has an upper row of holes 83 which receive the fasteners 72. It also has a lower row of holes 84 which are used for position latching purposes. Latching holes 84 are formed a short distance above the flanged lower side wall 82 of the track, and they extend throughout most of the length of the track.

Figure 7:
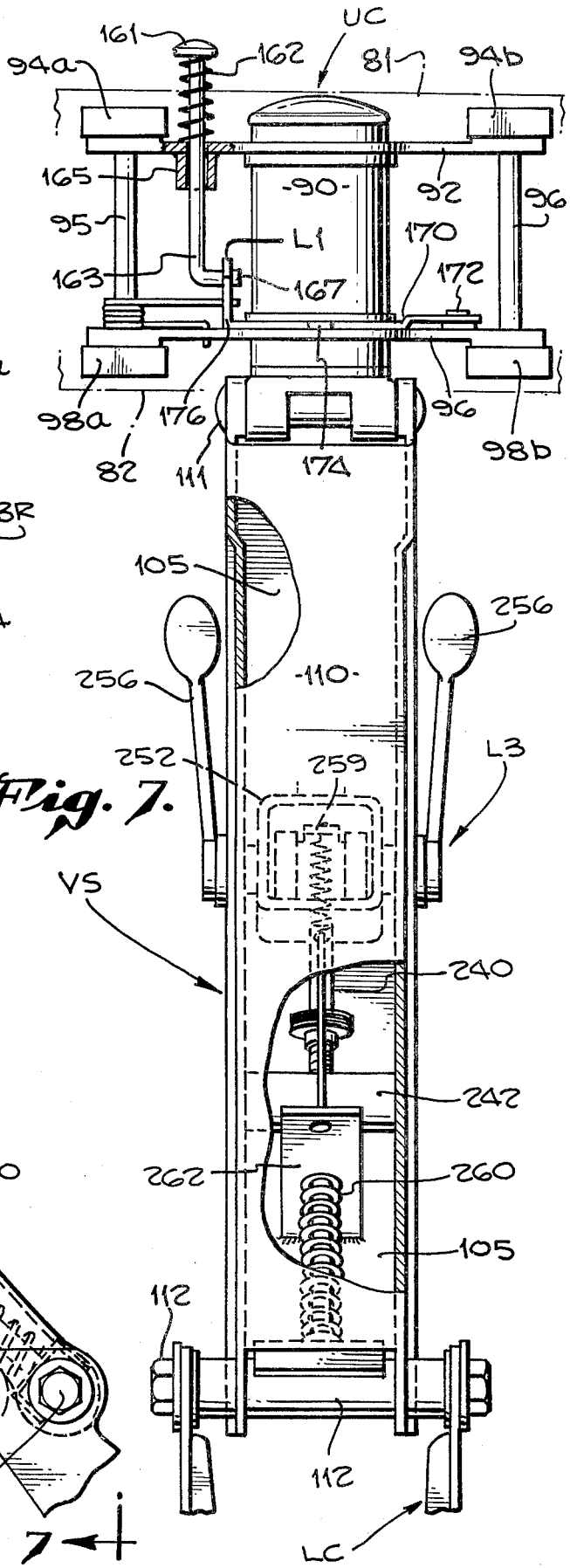
FIG. 7 is a front elevational view of the structure of FIG. 6 with a portion of the backrest member omitted, as seen along the plane 7—7 of FIG. 6.
Figure 8:
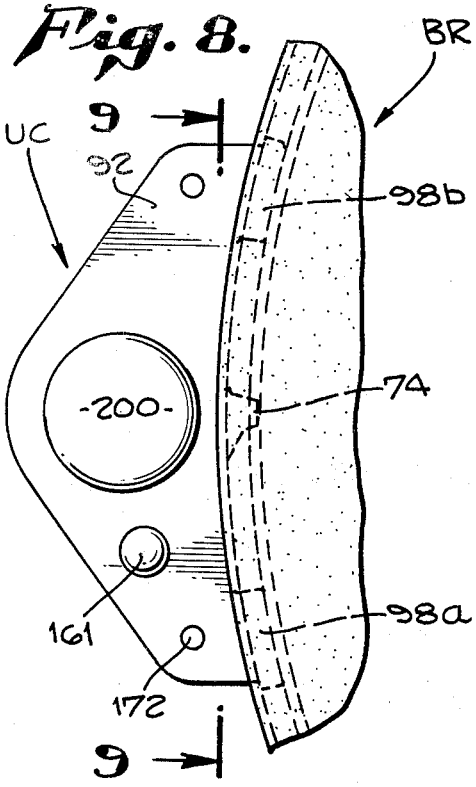
FIG. 8 is an enlarged plan view of the pivot of FIG. 4, showing further latch details thereof.
Figure 9:
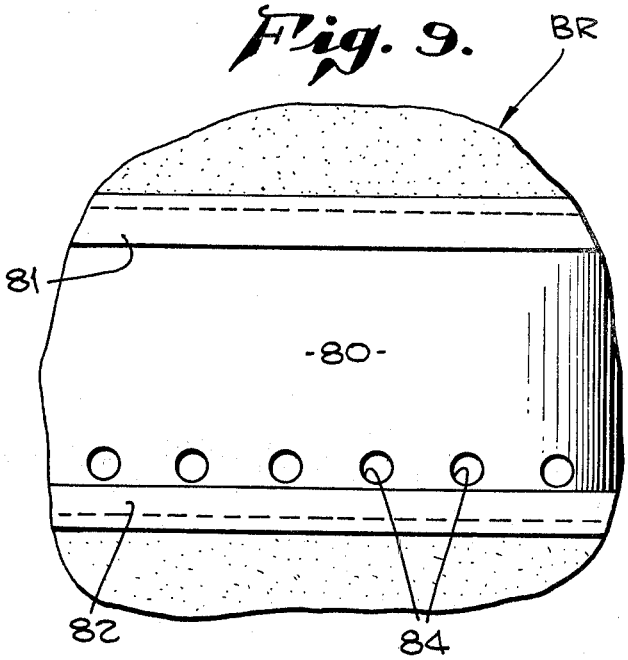
FIG. 9 is a partly sectional and partly elevational view of the rear side of the backrest, taken along the plane 9—9 of FIG. 8.
Figure 10:
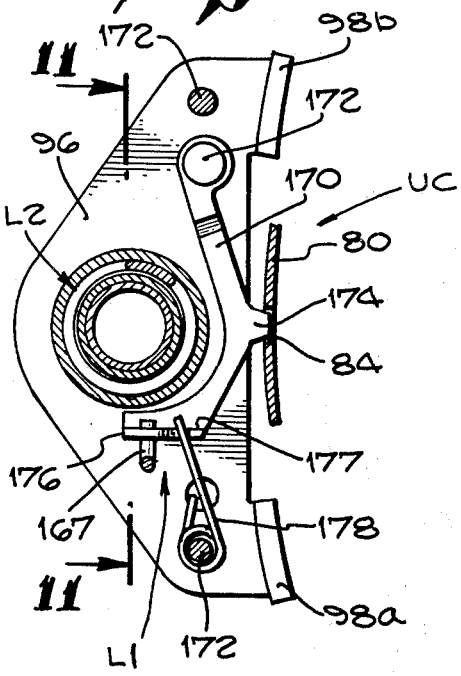
FIG. 10 is a sectional view of the pivot structure as taken along the plane 10—10 of FIG. 6.
Figure 11:
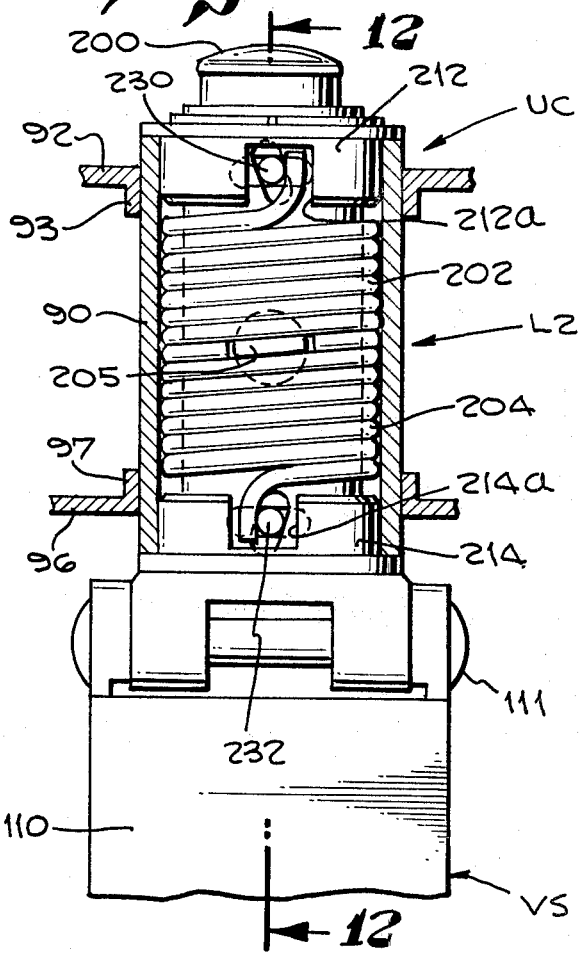
FIG. 11 is a sectional elevational view of the pivot structure, taken along the plane 11—11 of FIG. 10.

Upper carriage UC includes a cylindrical outer tube 90, FIGS. 6, 7, and 11, as its basic component. A parallel pair of upper and lower support plates 92, 96 are secured to the tube 90. As best seen in FIG. 11 the upper support plate 92 has a central opening on whose periphery the plate is flanged downwardly at 93, and the flange 93 is snugly received around the upper end of the tube 90 and is fastened thereto by welding or other appropriate means. In similar fashion the lower support plate 96 has a central opening whose edge is upwardly flanged at 97 and which grasps and is attached to the lower end of tube 90.

The metal track 80 is arcuately curved in the horizontal plane so as to conform to the shape of the backrest frame 70, to which it is attached in fixed relationship. The forward sides of support plates 92, 96 are similarly curved, and are equipped with feet or guides which engage the track 80 is sliding relationship therewith. Thus the upper support plate 92 has feet **94*a*, 94*b* which are upwardly turned from its respective ends for engaging the upper flange 81 of track 80, while lower support plate 96 on its respective ends has downwardly turned feet 98*a*, 98*b* for engaging the lower flange 82**.

In order to maintain the structural integrity of the upper carriage a pair of spacer bolts 95, 99 shown only in FIG. 7 are provided. Spacer bolt 95 separates the support plates 92, 96 adjacent the respective feet or guides **94*a*, 98*a*. Spacer bolt 99 separates the support plates adjacent the feet or guides 94*b*, 98*b***. Expansion nuts, not specifically shown, are preferably used in conjunction with the spacer bolts in order to adjust the spacing between the support plates, and hence between the feet or guides for optimum operation.

Several position latch parts are carried within or upon the upper carriage. One such position latch L1 is used for latching the horizontal position of the backrest BR, as for example, when it slides along an arcuate path between the centered position as shown in FIG. 4 and an offset position as shown in FIG. 5. Another latch mechanism L2 is used for latching the position of the backrest when it is rotated about the vertical axis of post 90, such as to the alternate position shown in dotted lines in FIG. 4. The structure and operation of these latches will be described in detail in a later part of this specification.

Figure 12:
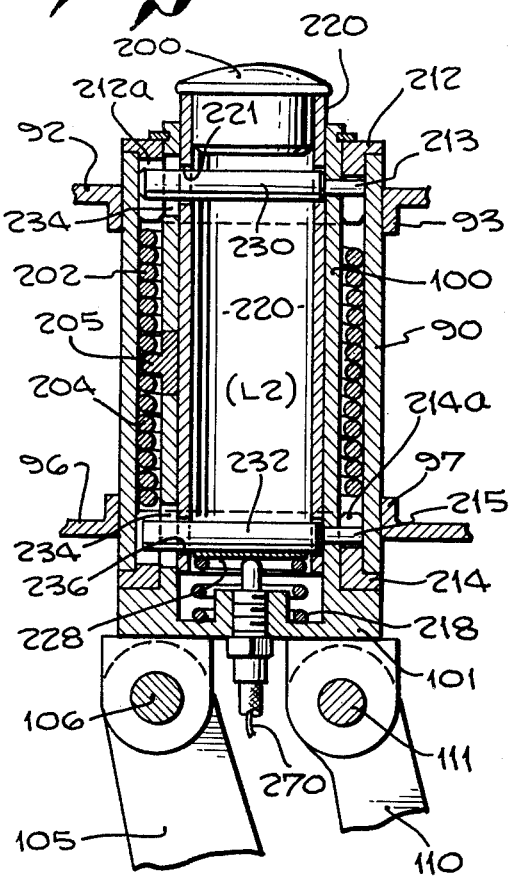
FIG. 12 is a sectional elevational view of the pivot structure, taken along the perpendicular plane 12—12 of FIG. 11.
Figure 15:
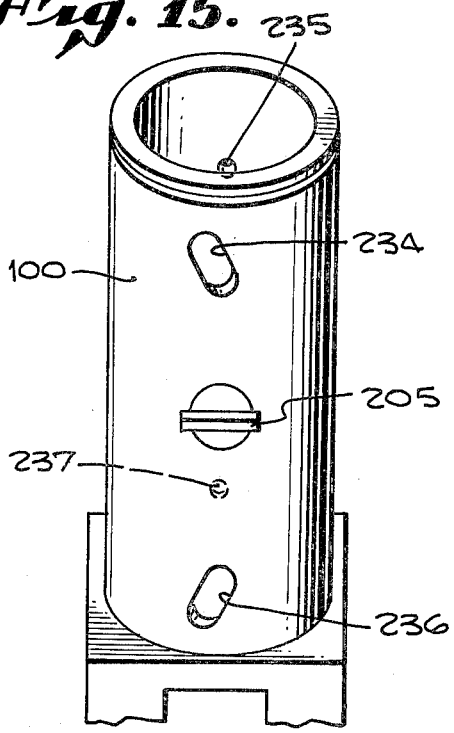
FIG. 15 is a perspective view of the intermediate sleeve of the pivot assembly.

Vertical support VS shown in FIGS. 3, 6, 7, 12, and 18 will now be described. An intermediate tube 100, FIGS. 12 and 15, is concentrically positioned within the tube 90 in supporting relationship therewith. A base block 101 is integrally formed on the lower end of tube 100. A lower space ring 102 of L-shaped cross-sectional configuration is carried upon the shoulder of base block 101 and secured thereto. An upper spacer ring 103 also of L-shaped cross-section is carried upon the upper end of tube 100 and secured thereto. The spacer rings 102, 103 have shoulders and flanges which receive the corresponding ends of outer tube 90 in a captive rotatable relation.

Thus the base block 101, with the associated tube 100 and spacer rings 212, 214, provides a supporting base to support the outer tube 90. As previously mentioned, tube 90 may rotate about its vertical axis relative to the support block 101. It is this rotational support which permits the rotational adjustment of backrest BR to the dashed line position shown in FIG. 4.

Vertical support VS also includes an outer generally channel-shaped member 105 and an inner generally channel-shaped member 110 which extend upwardly from lower carriage LC to the base block 101. The upper end of support member 105 is pivotally attached to the rearward or outer portion of base block 101 by means of a horizontal pin 106, while the upper extremity of support member 110 is pivotally secured to the inner extremity of base block 101 by means of a horizontal pin 111. The support members are pivotally secured at their lower ends to the lower carriage LC by means of horizontal pins 107, 112, respectively.

The base block 101, vertical support members 105 and 110, and frame 120 of the lower carriage together form a parallelogram whose position is adjustable. Horizontal pivot pins 106, 107, 111, 112 are all parallel to each other and are located at corresponding corners of the parallelogram. By adjusting the angular position of the parallelogram the associated backrest can be moved relatively closer to or farther away from the couch assembly. Thus FIG. 6 shows the backrest moved rearwardly away from the couch assembly, while FIG. 18 shows the backrest moved forwardly and hence some distance radially inwardly above the couch assembly. Latching mechanism L3 for latching the position of the parallelogram is described in a later paragraph.

Figures 20, 21:
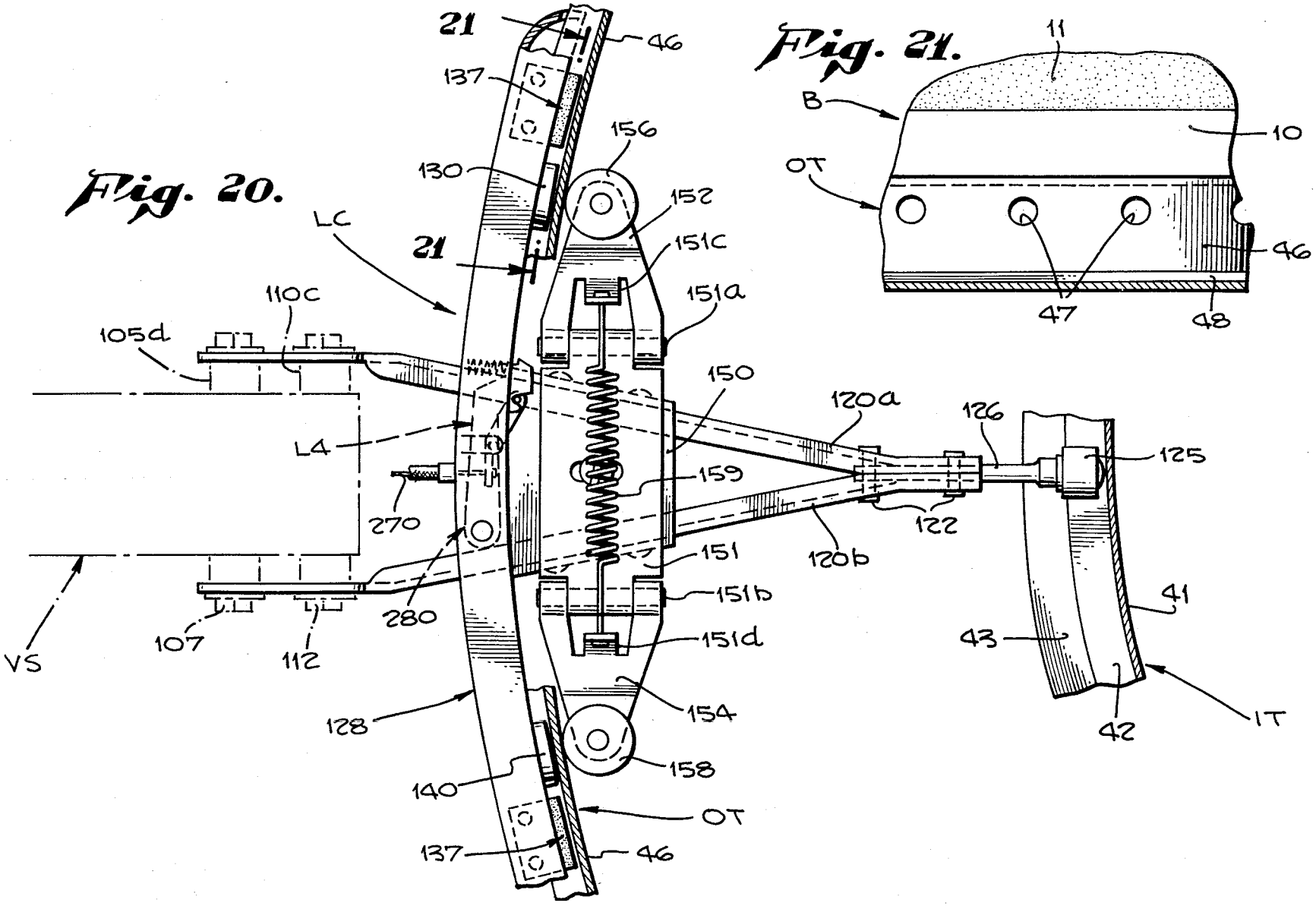
FIG. 20 is a plan view of the structure of FIG. 19, taken along the plane 20—20 of FIG. 19.
FIG. 21 is a view of a portion of the outer track taken along the plane 21—21 of FIG. 20.

Lower carriage LC includes as its main component part a V-shaped frame 120 whose configuration is best seen in FIGS. 19 and 20. This frame is actually made of two similarly shaped members 120*a*, 120*b*, FIG. 20. The outer ends of these frame members are parallel flat plates which receive the lower pivot pins 107, 112. Corresponding housings 105*c*, 105*d* for the pivot pins serve to maintain the desired horizontal spacing between the frame members 120*a*, 120*b*, and hence constitute a part of the vertical support VS.

A forward or inner roller 125 is supported on a spindle 126. The spindle 126 is received between the inner ends of frame members 120*a*, 120*b* which are then fastened together by means of suitable bolts or rivets 122. As also seen in FIG. 19, spindle 126 and frame 120 together form a somewhat L-shaped structure when viewed in the vertical plane.

Roller 125 rotates on a horizontal axis within the inner track IT, applying an upward force on the under surface of the upper wall 40. The spindle 126 has a horizontal portion on which the roller 125 is supported, and then is angled downward to its connection with the lower support frame 120. Support frame 120 extends underneath the outer track OT and is supported therefrom by rollers which are described below. The outer end of support frame 120 then bends upwardly such that the pivot pins 107, 112 are supported at an elevation which approximately coincides with the bottom surface of wooden base plate 10.

A saddle 128 (FIGS. 19, 20 and 22) is attached to the upper surfaces of the frame arms 120*a*, 120*b* immediately outboard of the outer track OT. Main rollers 130, 140 are carried within the saddle 128 and rollingly engage the upper surface of angled flange 48 of outer track OT. Thus the vertical support VS, and hence also the upper carriage and backrest, are provided with a cantilever support by the lower carriage LC, with outer rollers 130, 140 providing a lifting force from outer track OT while the single inner roller 125 provides a hold-down force from inner track IT.

Figure 22:
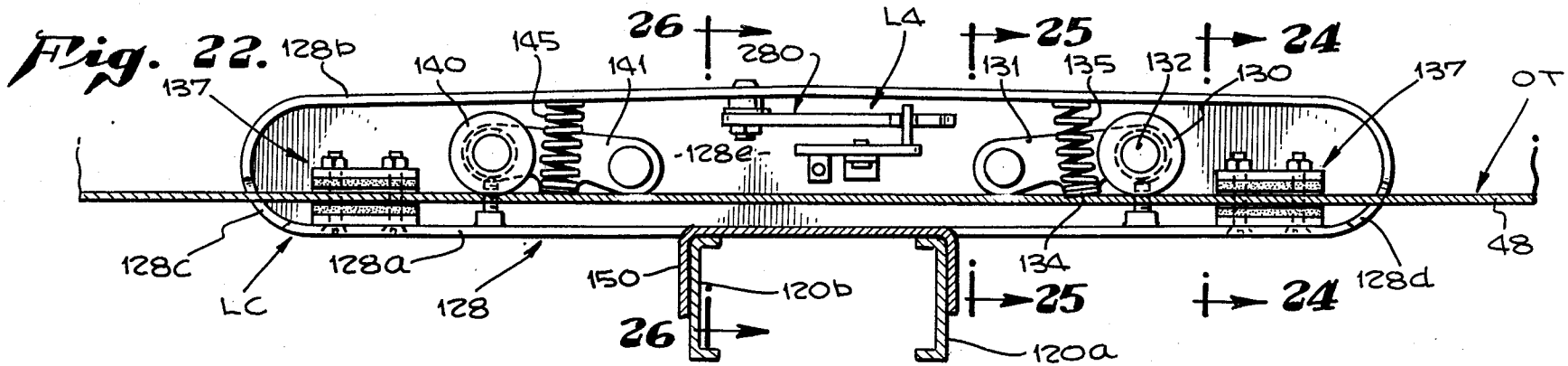
FIG. 22 is an elevational view of the saddle of the cantilever means, taken along the plane 22—22 of FIG. 19.

More specifically, as best seen in FIG. 22 the saddle 128 has an elongated horizontal lower wall 128*a* which extends transversely of the V frame 120 and is supported on the upper surfaces of the frame members 120*a*, 120*b*. The saddle also includes a horizontal upper wall 128*b* which is about two inches above the bottom wall and is generally parallel to the bottom wall. The end walls of the saddle are continuous and rounded and join the corresponding ends of the bottom and top walls, and also have respective notches 128*c*, 128*d* formed therein to provide clearance for the track flange 48. See FIG. 19. Saddle 128 also has a vertical outer or rear wall 128*e* which joins the bottom, top and end walls and provides a support base for the rollers 130, 140. The forward or inner side of the saddle 128 is completely open where it faces towards the outer track OT.

As best seen in FIG. 20 the saddle 128 is arcuately curved so as to fit the curvature of outer track OT. Outer track flange 48 lies at an angle of about 15 degrees to the horizontal, and saddle 128 and the rollers 130, 140 are tilted at the same angle so that each roller fully engages the upper surface of the flange. Rollers 130, 140 are not mounted directly on the saddle 128, but rather, are mounted indirectly through load-shifting springs. Thus roller bracket 131 (FIG. 22) is positioned inside the saddle in parallel relationship to the rear wall 128*e*, and one of its ends carries a shaft 132 upon which roller 130 is rotatably mounted. The other end of bracket 131 is pivotally attached to the rear wall by means of a pin 133. At its longitudinal center, on its lower side, bracket 131 has a horizontal flange 134. A compressed spring 135 is vertically aligned with its upper end engaging the upper wall 128*b* of the saddle while its lower end rests upon the flange 134. Thus, spring 135 tends to cause the bracket to pivot downwardly and thereby hold roller 130 in engagement with the angled flange 48.

Roller 140 is supported in a similar manner by bracket 141 and other correspondingly numbered parts.

Figure 25:
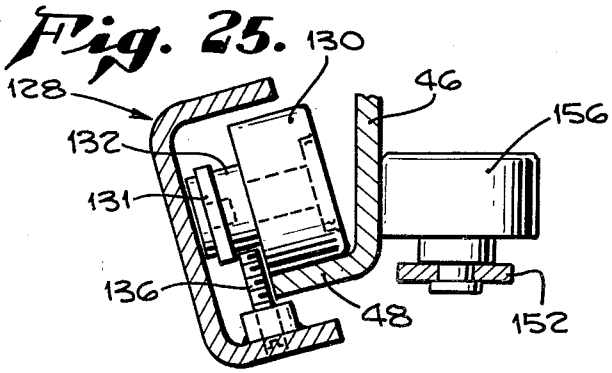
FIG. 25 shows the outer track and one outer roller, as taken on line 25—25 of FIG. 22.
Figure 24:
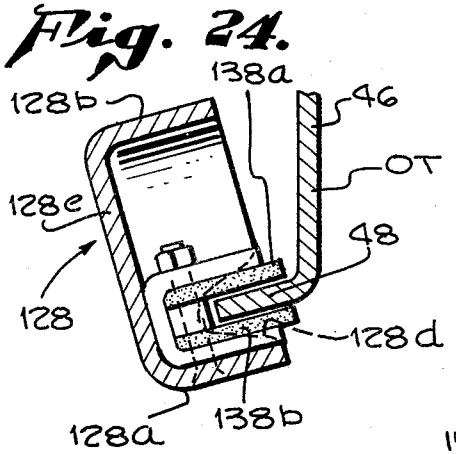
FIG. 24 is a view of one brake lining carried by the saddle, on line 24—24 of FIG. 22.

As best seen in FIG. 25 a stop pin 136 is secured to bottom wall 128*a* of the saddle and projects upwardly therefrom. Stop pin 136 is located immediately beneath the shaft 132 and limits the downward movement of roller 130. This limited downward movement of the rollers, in turn, ensures that the brakes which are now to be described will not normally engage the track flange 48.

A brake 137 located between roller 130 and the corresponding end of saddle 128 is supported upon and attached to the bottom wall 128*a*. It includes upper and lower brake blocks 138*a*, 138*b* which are positioned adjacent the upper and lower surfaces, respectively, of the angled track flange 48.

When the backrest BR is not loaded, that is, there is not a person leaning back against it, then the weight load upon the lower carriage LC is sufficiently small that the entire load can be carried by rollers 130, 140 and springs 135, 145. But when a person leans back against the backrest the resulting vertical load that must be carried by outer track OT is significantly increased. The result is that springs 135, 145 compress further and rollers 130, 140 move upward, so that upper brake pads 138*a*, 148*a*, engage the upper surface of angled flange 48. The major part of the load on track OT is then carried by the brake pads. The load transfer is accompanied by a movement of each roller 130, 140 upward from its lower limit position of about 0.030 inch.

Due to the fifteen degree slope of angled flange 48, lower carriage LC would fall off the tracks unless some provision were made to hold it there. This is accomplished by the alignment frame and alignment rollers shown in FIGS. 19, 20 and 23.

A support plate 150 formed as an extension of bottom plate 128*a* of saddle 128 rests upon the upper surface of frame members 120*a*, 120*b* on the radially inward side of track OT. An alignment frame 151 extends transversely across that plate and is adjustably positioned thereon. The alignment frame is provided with pivotal end extensions 152, 154, respectively, whose outer ends carry vertical pivot shafts 153, 155, respectively, upon which the alignment rollers 156, 158 are rotatably supported. A tension spring 159 is disposed above and parallel to the alignment frame 151, its ends being attached to corresponding spring brackets 152*a*, 154*a* of the alignment frame extensions.

Figure 23:
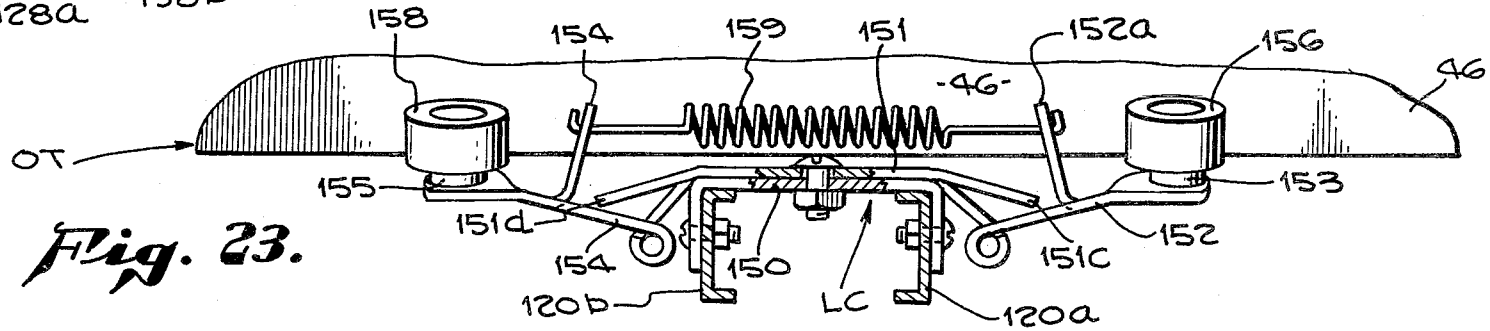
FIG. 23 is an elevational view of the saddle alignment frame and rollers, as seen along the plane 23—23 of FIG. 19.

The operating position of the alignment frame and alignment rollers is shown in both FIG. 20 and FIG. 23. Each of the alignment frame extensions 152, 154 has an upper limit position of pivotal movement provided by stops 151*c* and 151*d*, and is held in that position by the tension spring 159. Alignment rollers 156, 158 then turn on axes which are vertical. The alignment rollers also tightly engage the inner surface of wall 46 of the outer track OT as shown in FIG. 25. The engagement of alignment rollers 156, 158 with track wall 46 then establishes the radial position of the lower carriage. Outer rollers 130, 140 are thereby constrained from sliding outwardly on the angled flange 48. Inner roller 125 and its spindle 126 extend into the interior of inner track IT sufficiently to maintain a firm supporting engagement with the track. And as clearly shown in FIG. 20, the inner end of spindle 126 is spaced far enough away from the track wall 41 to avoid any scraping action.

The imposition of a load on the backrest, as by a person leaning back upon it, does not disturb the operation of the alignment frame and alignment rollers. As seen in FIG. 20 the frame extension 152 is attached to frame 151 by means of a pivot pin 151*a*. And frame extension 154 is attached to the other end of the frame by means of pivot pin 151*b*. The longitudinal axes of these pivot pins are substantially parallel to the longitudinal axis of inner roller 125. Imposing additional load upon the lower carriage causes a slight vertical movement of the alignment rollers but does not affect their operation.

The frame extensions 152, 154 make it easy to attach a backrest assembly to the couch assembly. These extensions are simply bent downward while rollers 125, 130, 140 are fully engaged, and then are released.

POSITION ADJUSTMENT MECHANISMS

The structure and operation of the various adjustment mechanisms will now be more fully described.

The backrest BR may be moved along an arcuate path from its centered position as shown in FIG. 4 to an off center position as shown in FIG. 5. It is then held in place by means of a latch mechanism L1 engaging one of the holes 84 in track 80. The structure and operation of this latch mechanism are described in a later paragraph.

The upper carriage UC and the backrest BR may be selectively rotated about the vertical axis of the tube 90, as for example between the two positions shown in FIG. 4. The upper carriage is then latched in its selected position by means of a second latch mechanism L2 which prevents the pivot assembly from turning. The structure and operation of this latch will also be described in a later paragraph.

The parallelogram structure of the vertical support VS may be placed in vertical alignment, or may be selectively inclined either towards or away from the couch assembly. During these movements the upper carriage UC remains parallel with the floor surface upon which the furniture piece is supported. It is then latched in place by a third latch mechanism L3, also to be subsequently described.

A latch mechanism L4 associated with lower carriage LC engages a selected one of the holes 47 in outer track OT, in order to lock the backrest assembly BRA in a selected circumferential position relative to the couch assembly. Latch mechanism L4 is actuated by the same control as latch L2.

Any of the four position adjustments may be used independently of the others if that is desired. As a result, the position of each one of the backrests relative to the couch assembly is almost infinitely variable. And when a particular position of adjustment has been selected, the four latch mechanisms now to be described will maintain it.

LATCH MECHANISM L1/ (FIGS. 6–10)

Latch mechanism L1 is shown in FIGS. 6–10, inclusive. A button 161 attached to the upper end of a square shaft 163 carrying return spring 162 is positioned above the upper support plate 92. Shaft 163 passes through a square hole in the support plate, and a guide 165 attached underneath the plate guides its movement. On its lower extremity the shaft 163 carries a cross-pin 167.

A latch plate 170 (FIGS. 6, 7, 10) is of generally narrow elongated configuration and disposed upon the upper surface of lower support plate 96. One end of the latch plate is positioned near the foot 98*b* where it is pivotally secured at 172 to the lowermost support plate 96. The latch plate extends partially around the tube 90, between the tube 90 and the track 80. Directly between the tube 90 and track 80 it has a protruding latch finger 174 (FIG. 10) which selectively engages one of the latch openings 84 in track 80.

At its other end the latch plate 170 has an upwardly turned flange 176. A notch 177 formed in the flange receives a spring 178 that normally urges the latch towards its closed or locked position. The flange also has a sloped or cam groove 179 (FIG. 6) which receives the end of the cross-pin 167.

Whenever button 161 is pressed downwardly, the square shaft 163 moves downwardly without rotation because it is confined in a square hole. Cross-pin 167 slides downwardly in the cam groove 179 and retracts the latch plate away from track 80, overcoming the force of spring 178, removing latch finger 174 from latch opening 84 in track 80, thereby unlatching backrest BR and allowing it to be translated with respect to the upper carriage UC. When the button is released the spring again forces the latch towards its closed position.

LATCH MECHANISM L2/ (FIGS. 11–15)

Figure 13:
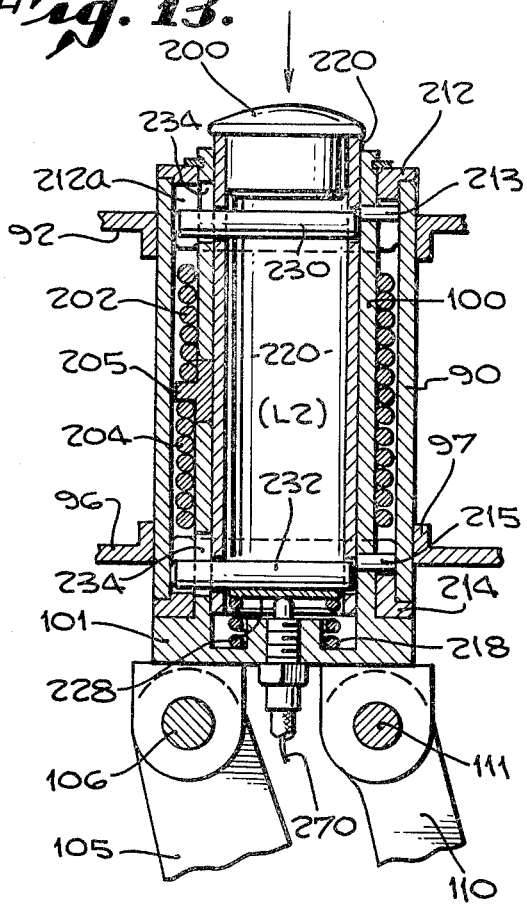
FIG. 13 shows the pivot of structure of FIG. 12 in releasing portions.

Latch mechanism L2 is controlled by release button 200, which is normally in a raised position as shown in FIG. 12 but may be depressed as shown in FIG. 13 in order to release the latch. Releasing the latch permits the backrest assembly and its pivot tube 90 to rotate about intermediate or base tube 100 of the vertical support VS.

An upper helical spring 202 and a lower helical spring 204 occupy the annular space between the tubes 90 and 100. Spring anchor 205 separates the lower end of spring 202 from the upper end of spring 204.

An upper bushing 212 (FIG. 11) extends about the upper end portion of base tube 100 and has a slot **212*a* which receives the up-turned end of upper spring 202. Bushing 212 is pinned to tube 100 at 213 (FIG. 13). In similar fashion a lower bushing 214 extends about the lower end portion of tube 100, has a slot 214*a* which receives the down turned lower end of lower spring 204, and is pinned to tube 100 at 215. Thus both ends of the springs 202, 204 are secured to tube 100** of the vertical support.

In the released condition of latch L2 as shown in FIGS. 11, 12 the spring 202, 204 is in an expanded state. It then engages the interior wall of pivot tube 90 with great frictional force, hence preventing rotation of the backrest. But when release button 200 is depressed as shown in FIG. 13 the spring is tightened and contracts, disengages itself from the wall of pivot tube 90, and therefore permits rotation of the backrest to take place.

Figure 14:
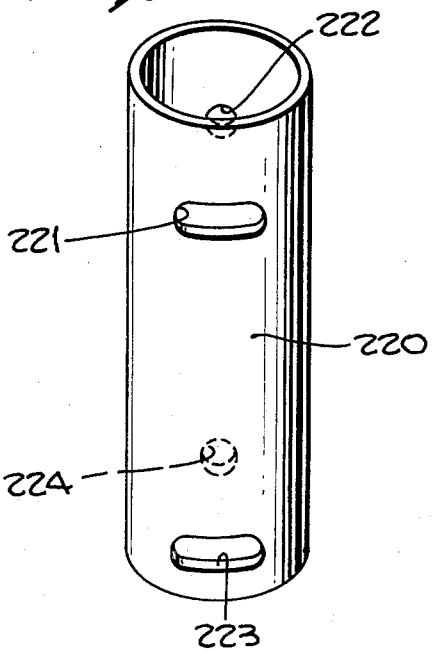
FIG. 14 is a perspective view of the innermost sleeve of FIGS. 11-13 in one position.

The release mechanism is described as follows. A latch tube 220 which is shown in perspective in FIG. 14 is concentrically disposed inside the intermediate or base tube 100. Release button 200 is attached to the upper end of latch tube 220. A short helical compression spring 218 is positioned between the lower end of tube 220 and the recessed bottom of base plug 101, FIGS. 12 and 13. Thus, when button 200 is depressed it works against the force of spring 218, and when it is released the spring 218 forces the latch tube 220 and button 200 back to their normal starting position.

Latch tube 220 has a horizontal upper slot 221 formed therein, and directly opposite and at the same elevation a small hole 222. An upper release pin 230 has one end contained in hole 222 while its other end extends through and beyond the slot 221. The latch tube also has a lower horizontal slot 223 opposite which, at the same elevation, it has a small hole 224 (dotted in FIG. 14). Lower release pin 232 occupies the hole 224 while its other end extends through and beyond the slot 223.

The intermediate or base tube 100 is shown in perspective in FIG. 15. At its vertical center it has an opening which carries the spring anchor 205. A cam slot 234 is formed near its upper end and a cam slot 236 is formed near its lower end, these two cam slots being oppositely sloped but being vertically aligned with each other and with the anchor. Small holes 235, 237 which are respectively opposite the cam slots 234, 236 receive the bushing pins 213, 215, respectively, which were previously described.

Thus the protruding end of upper release pin 230 extends through the cam slot 234 in base tube 100, and also extends into the slot **212*a* of bushing 212 on the outer side of the upturned end of spring 202. This is shown in FIG. 11. In similar fashion the protruding end of lower release pin 232 extends through lower cam slot 236 of base tube 100, and hence into the slot 214*a* of lower bushing 214 where it occupies the space on the outer side of the down turned end of spring 204**.

When release button 200 is depressed, there is a cam action produced by the movement of the release pins 230, 232 in the cam slots 234, 236, respectively of the base or intermediate tube 100. Latch tube 220 does not rotate significantly in either direction because the horizontal slots 221, 223 have significant horizontal width and permit the necessary horizontal movements of the release pins 230, 232 to take place concurrently and in opposite directions. Each release pin, by its sidewise horizontal movement, twists the end of the associated helical spring in such a direction that it becomes more tightly wound. The width of the slots in bushings 212, 214 is sufficient to permit the necessary amount of movement to occur. It is this twisting of the springs which causes them to disengage themselves from the interior wall of the pivot tube 90, thereby permitting upper carriage UC to rotate with respect to vertical support VS.

When release button 200 is released, the action reverses itself.

LATCH MECHANISM L3/ (FIGS. 6, 7, 16–18)

Latch mechanism L3 will now be described. It is used to lock the vertical support VS into a selected position leaning either towards or away from the couch assembly as shown in FIGS. 18 and 6, respectively.

The mechanism is shown in FIGS. 6, 7, and 16–18. A latch bolt 240 which is best seen in FIGS. 16 and 18 is vertically disposed within the interiors of the generally channel-shaped support members 105, 110. The lower end of bolt 240 is bayonetted into a transverse pivot bar 242 that is in turn journaled in ears **110*a* of support member 110. A retaining nut 244 is secured to the upper end of the latch bolt. A stack of bias washers 250 is supported within a rotatable housing 252 that in turned is journaled in side walls 105*a* of the support member 105. Latch handles 256 are attached to the key 254 through a screw 268 so as to drivingly rotate the key. The middle or upper portion of latch bolt 240 passes through a central opening in the bias washers 250**.

A tension spring 258 carried on arm 259 of the bias washer key 254 (see FIG. 18) normally keeps the washers twisted against the latch bolt 240 so that they retain it with a great deal of frictional force. The vertical support parallelogram that includes the vertical support members 105, 110 is then held in a fixed position.

However, one or both of the latch handles 256 may be pulled rearwardly, as indicated by the arrow in FIG. 18. The resulting rotation of key 254 loosens the grip of the bias washers upon the latch bolt. It is then possible to change the position of the parallelogram. Impact springs 240*a*, 240*b* located respectively on the upper and lower ends of latch bolt 240 absorb any impacts encountered during positioning. When a new position has been selected, the latch handles are released and the spring 258 again produces the normal locking action of the bias washers.

It will be noted that one end of latch bolt 240 is coupled to vertical support 110 while the other end is coupled to vertical support 105. When the length of the latch bolt between these two points of attachment is fixed, it then fixes the position of the parallelogram. Support member 105 is curved longitudinally, and pivot shaft 242 carried by member 110 is, in any position of adjustment, located substantially on a straight line between pivot shafts 107 and 254 carried by member 105. Thus, the latching mechanism forms an adjustable triangle.

The backlash spring 260 performs an important function in conjunction with locking the parallelogram. Spring 260 is a helical compression spring which is circumferentially disposed upon a guide rod 261 (FIG. 18). The lower end of that guide rod is attached to the housing of pivot shaft 112. The upper end of the guide rod passes through an opening in a bracket 262. Bracket 262 is positioned within the interior of vertical support member 105 and permanently affixed to it. The expansion force of spring 260 tends to push upward on the bracket 262 and hence tends to push the support member 105 in an upward or rearward direction. This keeps the backrest BR in the rearmost position that is permitted by the latch mechanism 240–259 (L3).

It must be assumed that there is some ambiguity or "slop" in the latch 240–259. Backlash spring 260 causes the parallelogram to move to the rearmost position that is permitted by that ambiguity. Thus, when a person is not leaning on the backrest, it is in its rearmost position. Then when a person does lean on it there is no significant additional movement. In other words, the backlash spring 260 has anticipated the adjustment in position that would otherwise have occurred when the backrest was subjected to load.

LATCH MECHANISM L4/

(FIGS. 6, 12, 13, 20–22, 26)

Figure 26:
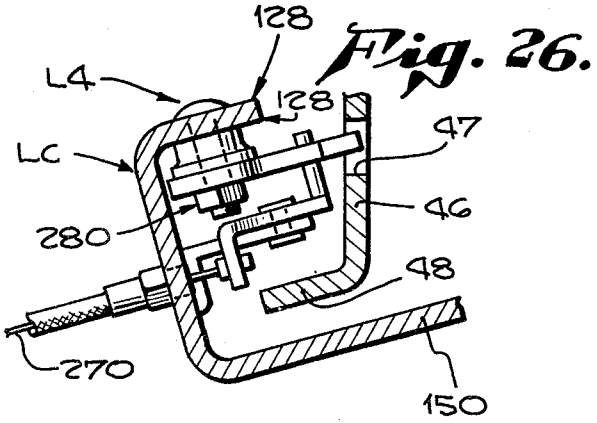
FIG. 26 shows the flexible cable release, latch, and outer track, taken on line 26—26 of FIG. 22.

A small plate 228 is positioned beneath lower release pin 232 so as to move up and down with the latch tube 220. See FIG. 13. The movement of this plate in turn actuates a flexible drive cable 270. The lower end of the drive cable is shown in FIGS. 20 and 26. It in turn actuates a latch mechanism 280 (FIG. 26) for selective disengagement from one of the latch holes 47 in outer track OT. The disengagement of the latch permits the backrest to be moved circumferentially around the couch assembly.

As earlier explained, latch mechanism L4 is actuated by the same actuator as latch mechanism L2. That is, depressing the button 200 actuates both of the latches L2 and L4 concurrently.

SECOND EMBODIMENT/

(FIG. 33)

The article of furniture shown in FIG. 33 includes a pair of backrests which may be identical to those already described, and a couch assembly CA2. Unlike the couch assembly initially illustrated, couch assembly CA2 is of a distinctly non-circular configuration.

Thus as shown in the top plan view of FIG. 33 the couch assembly CA2 is generally of circular configuration, but with a very large and irregular cutout 300 on one side and another large cutout 301 located about 180 degrees away. Inner and outer tracks 302, 303 which are shown in dotted lines as being supported on the underside of the couch extend along most of the periphery of the cutout 301 and also along the periphery of the immediately adjacent circular part of the couch. Inner and outer tracks 304, 305 extend along much of the periphery of cutout 300 as well as along the periphery of the adjacent circular portion of the couch. The two sets of tracks are not interconnected.

In the embodiment of FIG. 33 the manner of supporting each backrest assembly BRA from the tracks is the same as shown in the preferred embodiment. It will be noted from FIG. 2 and from FIG. 20 that the inner roller 125 and outer rollers 130, 140 provide a three point support for the backrest assembly. In the preferred embodiment the inner and outer tracks are concentric and are therefore equally radially spaced at all points around the circumference of the couch assembly. But the embodiment of FIG. 33 requires a small but significant variation in the spacing of the tracks.

More specifically, in the circular portions of couch assembly CA2 the radial spacing of the tracks is the same as in the preferred embodiment. Within the cutouts 300 and 301, however, the periphery of the couch while being smoothly curved is nevertheless curved in the reverse direction, i.e., concave rather than convex. In these locations it is therefore necessary for the tracks to be spaced closer together. Then the same three-point support by the rollers still keeps all of the rollers on the tracks.

A relatively sharp curve 310 occurs in the periphery of couch assembly CA2 at the juncture between cutout 300 and the adjacent circular couch portion. The curved portion 310 is curved much more sharply than the circular portion of the couch; therefore, in this location the inner track is spaced further away from the outer track than it is in the preferred embodiment. The same is true of a curved portion 311 which joins the cutout 301 to the circular part of the couch.

In the drawing of FIG. 33 the small letters a, b, c are used to indicate the different track spacings. Track spacing "a" is the standard spacing, i.e., the same as in the preferred embodiment. Spacing "b" is the reduced spacing which accompanies reverse curvature of the periphery of the couch. And spacing "c" is the enlarged spacing which occurs where the convex curvature of the couch is sharper.

Although legs to support the couch assembly CA2 are not specifically shown in the drawing, it will nevertheless be understood that they are located interiorly of the inner track 302 or 304, or else that they are located in an area of the couch assembly where the tracks do not extend so as to avoid obstructing the movement of the roller frame which travels along the pair of rails for supporting the associated backrest.

THIRD EMBODIMENT/

(FIGS. 34 and 35)

FIGS. 34 and 35 illustrate a preferred embodiment of the invention which again includes the single couch assembly and two backrest assemblies, but with the construction of both being different than previously illustrated.

Thus the couch assembly CA3 rests upon a single central post 320 which is in turn supported by a pedestal or base P. One backrest assembly BRA 3 has as its lower carriage a horizontal beam 330 whose inner end is journaled on the post 320 at 331. The other backrest assembly includes a horizontal beam 340 whose inner end is journaled to the post at 341. Journal 331 is located below the journal 341, and this is compensated for by a small vertical extension 330*a* on the outer end of beam 330 so that both of the backrests may of identical construction above their lower carriage portion and at the same time be positioned at equal elevations.

In operation, each backrest of FIGS. 34–35 may be moved around the periphery of the couch assembly simply by rotating its supporting beam 330 or 340 on the corresponding journal carried by the post 320. Position latches, not specifically shown, may be provided for latching each backrest in a desired circumferential position.

As far as other position adjustments are concerned, each backrest in the third embodiment may, if desired, be identical to those described in the preferred embodiment. That is, movement of the backrest over or away from the cushioned horizontal surface, or rotating it about a vertical axis, or translating it horizontally relative to that vertical axis, may if desired all be accomplished with the same mechanisms as previously illustrated and described in detail.

FOURTH EMBODIMENT

Figure 36:
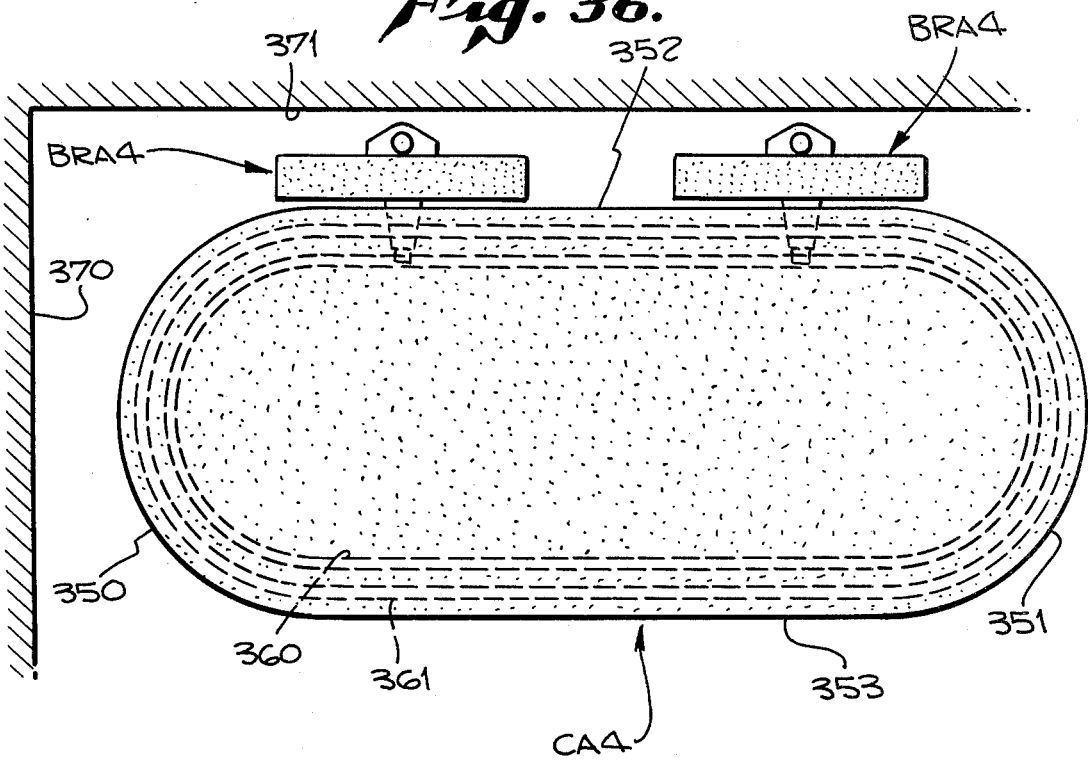
Figure 37:
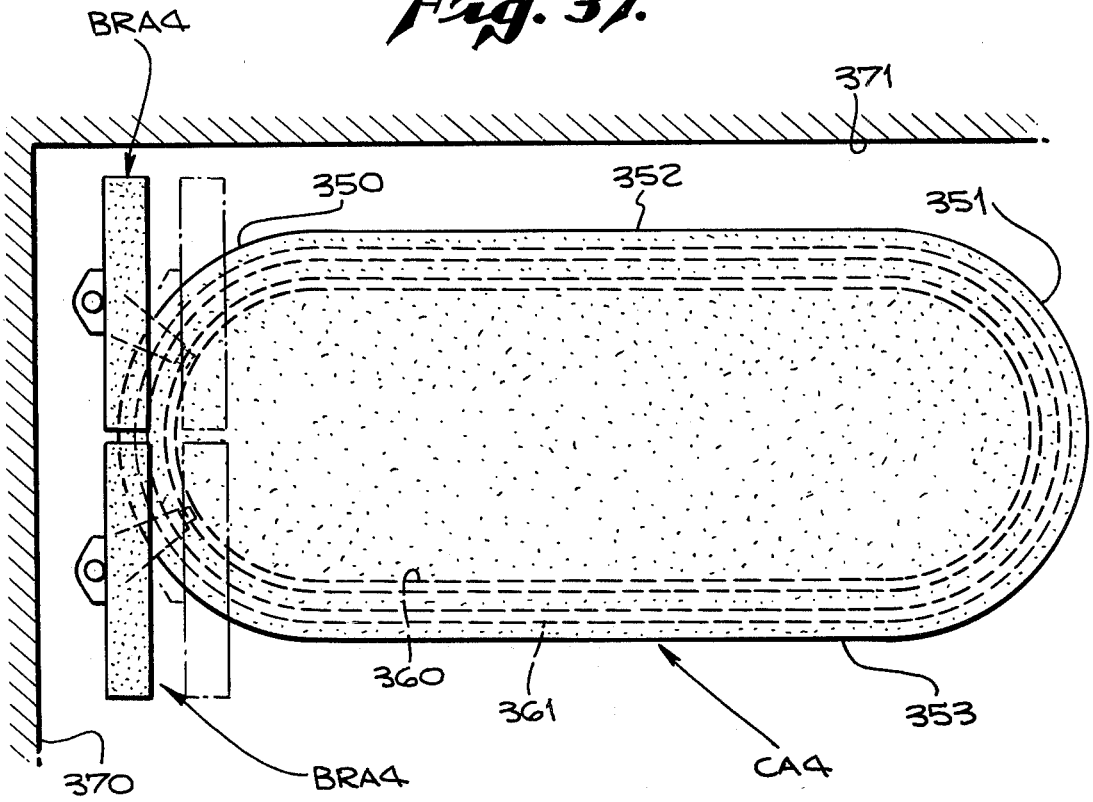
FIG. 37 is another plan view of the embodiment of FIG. 36 with the backrests in different positions.

(FIGS. 36 and 37)

The fourth embodiment of the invention illustrated in FIGS. 36 and 37 includes a pair of backrest assemblies BRA4 and a couch assembly CA4. Each backrest assembly is constructed and arranged in the same manner as that described in the preferred embodiment, except that the backrest member itself is straight rather than being curved, and the interfitting part of the upper carriage is also straight rather than curved.

Couch assembly CA4 has an elongated rectangular configuration, but with each end of the couch being formed as a semi-circle. These semi-circular ends are designated 350, 351. The couch also has rather long straight side edges 352, 353. The length of each straight side 352, 353 is about one and one-half times the diameter of a circle that would be formed by placing the two semi-circular ends 350, 351 together.

Couch assembly CA4 also has an inner track 360 and an outer track 361 which are carried on its underside, and therefore shown in dotted lines. Both of the tracks extend continuously around the entire periphery of the couch.

FIGS. 36 and 37 illustrate the method of using the invention alternately as a couch and as a bed within a crowded room space. Thus the corner portion of a room is indicated by a relatively short wall 370 which is perpendicular to a relatively long wall 371. The couch CA4 is positioned with its long side 352 being parallel to the long wall 371.

In the position shown in FIG. 36, both of the backrest assemblies are positioned adjacent the long straight edge 352 of the couch, next to wall 371. The entire article of furniture may then be used in conventional fashion as a daytime couch for seating two persons.

In the position shown in FIG. 37 both of the backrest assemblies are positioned on the curved end 350 of the couch adjacent the wall 370. The two backrests are rotated relative to their associated supporting assemblies so that they are aligned in a common vertical plane parallel to the wall 370. In this condition the article of furniture may be used as a bed with the two backrests forming a single headpiece for the bed.

ADVANTAGES

One advantage of the invention is the versatility which results from its modular construction. As one example, a relatively small couch assembly of any desired configuration, either circular or otherwise, may be utilized in conjunction with a single backrest assembly. Alternatively, a larger couch assembly may be equipped with three or more backrest assemblies.

Another advantage of the invention is that each backrest assembly may be easily detached from an associated couch assembly for purpose of shipment or storage. Furthermore, a particular couch assembly may at times be equipped with a set of backrest assemblies, but when special circumstances require a different manner of usage, the backrest assemblies may simply be removed and placed temporarily in storage.

A further advantage of the removability of the backrest assemblies is that it facilitates any replacement or repair work that might be necessary. Also, as described in detail in conjunction with the preferred embodiment, the preferred method of constructing the cushioned surfaces is such that the cushion members and their covers may be removed and replaced in the field, without the necessity of sending any part of the furniture back to a factory or repair shop.

While in the present disclosure particular modes of adjustment for the backrest assemblies have been illustrated, it will nevertheless be understood that it is within the scope and purpose of the invention to provide multiple adjustments including any specific kinds of adjustment that may be desired.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An adjustable article of furniture usable by at least two people concurrently as a lounge chair, couch, bed or the like, comprising:

a unitary main frame having means thereon forming a cushioned horizontal surface;

a plurality of movable backrests positioned along the border of said cushioned horizontal surface, each of said backrests including a vertical support member, means supporting the lower portion of said vertical supporting member from said main frame, and a horizontal backrest member secured to the upper portion of said vertical supporting member at a level above the elevation of said cushioned horizontal surface, the space above said cushioned horizontal surface being otherwise unobstructed;

each said vertical support member and its associated supporting means cooperating with said main frame to permit horizontal displacement of the corresponding backrest along a path substantially parallel to the border of said cushioned horizontal surface;

each of said backrests being independently movable along the border of said cushioned horizontal surface; and each of said backrests having means for adjusting the angular relationship of its horizontal backrest member to said cushioned horizontal surface independently of the other backrests.

2. The apparatus of claim 1 wherein said backrest members are horizontally elongated in an arcuate contour to fit the back of a person.

3. The apparatus of claim 1 wherein each of said movable backrests includes means adjustably securing the horizontal backrest member to the vertical support member, the position of the horizontal backrest member being adjustable laterally of the associated vertical support member as well as being rotatable about a vertical axis relative thereto.

4. The apparatus of claim 1 wherein each of said movable backrests further includes means for adjustably tilting the associated vertical support member towards or away from the margin of said cushioned horizontal surface.

5. Apparatus as in claim 1 wherein said cushioned horizontal surface is of non-circular configuration with a smoothly contoured border.

6. The apparatus of claim 1 which further includes leg means supporting said main frame above a floor surface, said means supporting the lower portion of said vertical supporting member having a cantilevered securement to the underside of said main frame.

7. The apparatus of claim 6 which includes inner and outer tracks carried on the undersurface of said main frame, said cantilevered securement including separate wheels engaging corresponding ones of said tracks.

8. An adjustable article of furniture usable by at least two people concurrently as a lounge chair, couch, bed, or the like, comprising:

a unitary main frame having means thereon forming a cushioned horizontal surface with a smoothly contoured border;

a plurality of movable backrests positioned along said border, each of said backrests including a vertical supporting member, cantilever means supporting the lower portion of said vertical supporting member from said main frame, and a horizontal backrest member secured to the upper portion of said vertical supporting member at a level above the elevation of said cushioned horizontal surface, the space above said cushioned horizontal surface being otherwise unobstructed;

each said vertical supporting member and its associated supporting means cooperating with said main frame to permit horizontal displacement of the corresponding backrest along a path substantially parallel to the border of said cushioned horizontal surface;

each of said backrests being independently movable along the border of said cushioned horizontal surface; and each of said backrests having means for adjusting the positional relationship of its horizontal backrest member to the border of said cushioned horizontal surface independently of the other backrests.

9. The apparatus of claim 8 wherein each of said movable backrests includes means adjustably securing the horizontal backrest member to the vertical support member, the position of the horizontal backrest member being adjustable laterally of the associated vertical supporting member as well as being rotatable about a vertical axis relative thereto.

10. The apparatus of claim 8 wherein each of said movable backrests further includes means for adjustably tilting the associated vertical supporting member towards or away from the margin of said cushioned horizontal surface.

11. A couch comprising a flat bed having a top surface for sitting or reclining thereon, leg means spaced inwardly from the periphery of the bed for supporting the bed above the floor surface, a plurality of backrests positioned along the border of the bed and extending above its top surface, and a plurality of support means associated with corresponding ones of the backrests, each support means extending downward beside and hence underneath the bed and being secured by cantilever means to a pair of generally parallel tracks on the underside of the bed, each support means being individually movable around a substantial portion of the perimeter of the bed so that the backrests can be adjustably positioned laterally relative to each other and relative to the bed.

12. A couch comprising a flat bed having a top surface for sitting or reclining thereon and having a smoothly contoured border, a first track on the underside of the periphery of the bed and extending around a substantial portion of its perimeter, a second track on the underside of the bed spaced inwardly from the first track, leg means secured to the underside of the bed inwardly of said second track for supporting the bed above a floor surface, a plurality of backrests positioned along the border of the bed and extending above its top surface, and individual support means for each of said backrests, each support means extending down beside and hence underneath the bed and being supported in cantilever fashion from said two tracks, each support means being individually movable around a substantial portion of the perimeter of the bed so that the backrests can be adjustably positioned laterally relative to each other and relative to the bed.

13. An adjustable and convertible piece of furniture for accommodating one or more persons in a selected one of various positions, comprising, in combination:

a support assembly including a cushioned surface;

a backrest assembly including a backrest supported from said support assembly, means for selectively moving the backrest over or away from said cushioned surface, and means for selectively rotating the backrest about an axis substantially normal to said cushioned surface; and said two assemblies mutually providing means for selectively moving said backrest peripherally of said cushioned surface.

14. The piece of furniture of claim 13 which further includes means for locking the backrest in a selected position of adjustment.

15. The piece of furniture of claim 13 which further includes means for selectively translating said backrest relative to said backrest assembly.

16. The piece of furniture of claim 13 which includes two said backrest assemblies.

17. The piece of furniture of claim 15 which includes two said backrest assemblies.

18. An adjustable article of furniture for accommodating two persons in selected positions of rest, comprising, in combination:

a couch assembly having a cushioned horizontal surface;

a pair of movable and adjustable backrest assemblies positioned along the border of said cushioned horizontal surface, each of said backrest assemblies including a lower carriage, an upper carriage supported from and above said lower carriage, and a backrest carried by said upper carriage;

each of said lower carriages being supported by cantilever means from the underside of said couch assembly;

each of said lower carriages being independently movable around the periphery of said couch assembly; and each of said backrest assemblies having means providing three separate adjustments for adjusting the position of the associated backrest relative to its supporting lower carriage, and including means for locking the backrest in its selected position of adjustment.

19. The furniture of claim 18 wherein said couch assembly includes centrally located support legs, and a pair of peripherally extending tracks located on its underside, said tracks having a fixed radial separation; and each of said lower carriages has inner and outer rollers which supportingly engage corresponding ones of said tracks.

20. The method of supporting two persons in selected positions of rest upon a single horizontal cushioned surface above a supporting base, comprising the steps of:

selecting a pair of backrests;

positioning the backrests along the border of the cushioned surface and securing them to the supporting base to be supported thereby;

moving at least one of the backrests around the border of the cushioned surface to a desired circumferential location thereon;

moving at least one of the backrests by a selected horizontal distance over or away from the cushioned surface; and rotating at least one of the backrests by a desired amount about a vertical axis relative to the cushioned surface.

21. The method of claim 20 which includes the further step of translating said last-named backrest a desired distance relative to said vertical axis, in a direction not parallel to the border of the cushioned surface.

22. A couch assembly comprising, in combination:

a flat supporting base having a horizontal cushioned surface thereon, the border of said cushioned surface being smoothly curved throughout at least most of its perimeter;

centrally located leg means underneath said base for supporting the same;

an outer track disposed beneath said base near its periphery and extending along said smoothly curved perimeter of said cushioned surface, said outer track having a substantially horizontal track member spaced beneath said base and supported therefrom; and an inner track disposed beneath said base at a fixed radial distance inward from said outer track, said inner track having a horizontal track member secured to said base;

whereby a movable carriage having a pair of outer rollers positioned above the track member of said outer track and an inner roller positioned below the track member of said inner track may be supported in cantilever fashion from said tracks.

23. In an article of adjustable furniture, the combination comprising:

a couch assembly having a supporting base, an outer track underneath said base along the periphery thereof, and an inner track underneath said base and substantially parallel to said outer track;

a movable carriage adapted to be selectively moved along the periphery of said couch assembly, having a pair of outer rollers adapted to ride upon the upper side of said outer track and an inner roller adapted to ride underneath said inner track, said rollers together providing a three point cantilever support for said carriage; and selectively actuable means for locking said carriage in a selected circumferential position relative to said couch assembly.

24. The combination of claim 23 wherein said couch assembly, said outer track, and said inner track are circular, and said inner track is concentric to said outer track.

25. In an article of furniture, an adjustable backrest comprising, in combination:

upper and lower carriages;

a backrest member secured to said upper carriage;

a pair of generally parallel vertical support members;

means pivotally coupling the lower ends of said support members to said lower carriage and the upper ends thereof to said upper carriage, said pivot means extending generally parallel to said backrest member and defining the four corners of a parallelogram;

a latch bolt having one end thereof pivotally coupled to one of said support members at a mid-point thereon;

brake means pivotally secured to a mid-point on the other support member, said two mid-points being vertically offset from each other;

said latch bolt passing through said brake means; and means for actuating said brake means so as to fix said parallelogram in a selected position of adjustment.

26. In an article of furniture, an adjustable backrest assembly comprising, in combination:

a lower carriage;

an upper carriage;

vertical support means supporting said upper carriage at a substantially constant elevation above said lower carriage, and being pivotally adjustable in a vertical plane to selectively position said upper carriage directly above said lower carriage or horizontally displaced therefrom;

said lower carriage having a plurality of support wheels adapted to travel on supporting tracks that extend perpendicular to said vertical plane;

a backrest carried by said upper carriage and rotatable thereon about a vertical axis; and separate latch means for securing said rotatable adjustment, said pivotal adjustment, and the lateral movement of said lower carriage on said supporting tracks, respectively.

* * * * *